US006526715B2

(12) United States Patent
Kaneko et al.

(10) Patent No.: US 6,526,715 B2
(45) Date of Patent: Mar. 4, 2003

(54) EXTERNAL WALL CONSTRUCTION

(75) Inventors: Shinichi Kaneko, Nagoya (JP); Takuo Ishiko, Nagoya (JP)

(73) Assignee: Nichiha Co., Ltd., Nagoya (JP)

( * ) Notice: Subject to any disclaimer, the term of this patent is extended or adjusted under 35 U.S.C. 154(b) by 0 days.

(21) Appl. No.: 09/740,871

(22) Filed: Dec. 21, 2000

(65) Prior Publication Data

US 2001/0004821 A1 Jun. 28, 2001

(30) Foreign Application Priority Data

Dec. 24, 1999 (JP) ..... 11-367340
Mar. 10, 2000 (JP) ..... 2000-067251

(51) Int. Cl.[7] ..... B04F 13/02

(52) U.S. Cl. ..... 52/483.1; 52/407.5; 52/591.4; 52/417; 52/461

(58) Field of Search ..... 52/481.1, 483.1, 52/489.1, 457, 461, 730.7, 417, 407.5, 302.3, 95, 448, 591.4

(56) References Cited

U.S. PATENT DOCUMENTS

| | | | | | |
|---|---|---|---|---|---|
| 2,066,006 | A | * | 12/1936 | Kellogg | 52/489.2 |
| 2,814,080 | A | * | 11/1957 | Tvorik et al. | 52/287.1 |
| 3,816,199 | A | * | 6/1974 | Dawdy et al. | 52/483.1 |
| 3,826,055 | A | * | 7/1974 | Bobzin et al. | 52/483.1 |
| 3,881,292 | A | * | 5/1975 | Porter | 52/461 |
| 5,345,739 | A | * | 9/1994 | Menchetti | 428/122 |
| 5,487,250 | A | * | 1/1996 | Yount et al. | 52/417 |
| 5,718,092 | A | * | 2/1998 | Corston | 52/403.1 |
| 5,987,835 | A | * | 11/1999 | Santarossa | 52/309.8 |
| 6,032,426 | A | * | 3/2000 | Tamlyn | 52/287.1 |

FOREIGN PATENT DOCUMENTS

| | | | | |
|---|---|---|---|---|
| JP | 58-195660 | | 11/1983 | |
| JP | 59-36570 | | 10/1984 | |
| JP | 3-180642 | * | 8/1991 | |
| JP | 4-306352 | * | 10/1992 | 52/483.1 |
| JP | 4-347257 | * | 12/1992 | 52/483.1 |
| JP | 5-248012 | * | 9/1993 | |
| JP | 7-40022 | | 9/1995 | |
| JP | 7-252928 | | 10/1995 | |
| JP | 7-305479 | * | 11/1995 | |
| JP | 8-21061 | | 1/1996 | |
| JP | 8-144470 | | 6/1996 | |
| JP | 9-49277 | | 2/1997 | |
| JP | 9-96020 | | 4/1997 | |
| JP | 9-125543 | | 5/1997 | |
| JP | 10-61040 | | 3/1998 | |
| JP | 10-273931 | | 10/1998 | |
| JP | 2592501 | | 1/1999 | |
| JP | 11-107366 | | 4/1999 | |
| JP | 11-210118 | | 8/1999 | |
| JP | 11-256717 | * | 9/1999 | |
| JP | 11-264225 | | 9/1999 | |
| JP | 3063214 | | 10/1999 | |

OTHER PUBLICATIONS

Article from Nikkei Architecture, pp. 47–49, Mar. 20, 2000.

* cited by examiner

*Primary Examiner*—Lanna Mai
*Assistant Examiner*—Winnie Yip
(74) *Attorney, Agent, or Firm*—Oblon, Spivak, McClelland, Maier & Neustadt, P.C.

(57) ABSTRACT

An external wall construction includes a building framework of a building and a bearing wall constituted with a plurality of ceramic type external wall panels to be fixed to the building framework. The external wall panels are formed by backing resin sheets on rearward surfaces thereof. Waterproof tapes are interposed between the external wall panels and the building framework.

15 Claims, 24 Drawing Sheets

EXTERNAL WALL CONSTRUCTION

BACKGROUND OF THE INVENTION

1. Field of the Invention

The present invention relates to an external wall construction comprising a bearing wall constituted by fixing a plurality of ceramic type external wall panels to a building framework of a building through framework wall construction methods or skeleton framing wall construction methods.

2. Description of the Related Arts

Conventional external wall constructions for building structural panels are known to be external wall constructions that are constructed through framework wall construction methods or skeleton framing wall construction methods.

An example of such a conventional external wall construction 9 is illustrated in FIG. 19.

This external wall construction 9 includes a building framework 92 constituted of framing materials 921 such as squared logs, building structural panels 93 fixed on the building framework 92, waterproof sheets 94 set on the building structural panel 93, lateral furring strips 95 fixed on the building structural panels 93 with the waterproof sheets 94, and external wall panels 96 for example ceramic type panels fixed on the building structural panels 93 with the lateral furring strips 95 (see FIGS. 19 and 20).

The building structural panels 93 are unified with the building framework 92 to form a bearing wall 930 which resist the vertical or horizontal pressure, and thus a security of constructional bearing strength is secured.

The constructing process of this external wall construction 9 includes framing the building framework 92 with the framing materials 921 in the first step, fixing the building panels 93 by face-nailing nails 935 on the building framework 92 in the second step (As a result, bearing wall 930 is formed.), fixing lateral furring strips 95 on the building structural panels 93 interposing the waterproof sheets 94 by nailing in the third step, and fixing the external wall panels 96 for example ceramic type panels on the building structural panels 93 interposing the lateral furring strips 95 by nailing in the fourth step.

A coating material is applied to a front surface of the external wall panels 96 as necessary.

In this manner, the external wall construction 9 can be obtained.

However, such a conventional external wall construction 9 presents following drawbacks.

The aforementioned external wall construction 9 has many components i.e. the building framework 92, the building structural panels 93, the waterproof sheets 94, the lateral furring strips 95, and the external wall panels 96. Consequently the construction is extremely complicated (see FIGS. 19 and 20).

And the complicated construction causes requirements of many construction steps and also leads to increased material costs.

And the aforementioned external wall construction 9 except for the building framework portion is so thick that effective indoor spaces are reduced.

It would be thinkable to fix the external wall panels 96 directly to the building framework 92 through face-nailing with the furring strips 95 being interposed therebetween. However, in case the external wall panel is ceramic type, cracks 966 or chippings 967 are apt to be generated through face-nailing in peripheries of portions at which nails 935 pierce through rearward surfaces 961 of the panels as illustrated in FIG. 21 since the external wall panels 96 do not exhibit particular shock-resistant characteristics. Consequently, fixing force of the external wall panels 96 to the building framework 92 will be degraded and may cause leakage of water.

While it is possible to prevent penetration of water into the interior of the building (arrow B in FIG. 20) by the provision of the waterproof sheets 94 in the external wall construction 9, absorption of water of the external wall panels 96 themselves from their rearward surfaces 961 cannot be prevented.

So, generally, the rearward surfaces 961 of the external wall panel 96 is coated by sealer, but the treatment is still insufficient to prevent absorption of water. As a result absorption of water may occur particularly through the cracks 966 or chippings 967. Such absorption of water may cause dimensional changes in the external wall panels 96. Moreover, if carbon dioxide penetrates through portions of the cracks 966 or chippings 967, carbonation or neutralization of external wall panels 96 through aging may be promoted and may lead to deterioration in durability.

There is a drawback that preventing condensation on indoor surfaces of the external wall panels 96 or building framework 92 may become difficult when the external wall panels 96 is directly fixed to the building framework 92.

More particularly, when the external wall panels 96 is directly fixed to the building framework 92 as illustrated in FIG. 24(A), heat insulators 98 are formed on indoor sides of the external wall panels 96. Particularly during wintertime, air 7 of high temperature and humidity residing indoors passes through the heat insulators 98 and reaches the interior of the external wall panels 96. The temperature of the proximity to the external wall panels 96 is low during wintertime, since it is close to outside-air temperature. Thus, the air 7 of high temperature and humidity passing from indoors through the heat insulators 98 is cooled to result in condensation on inner surfaces of the external wall panels 96, the heat insulators 98, and the surface of the building framework 92.

In an arrangement in which the building structural panels 93 are fixed to the building framework 92 and in which the external wall panels 96 are constructed with the lateral furring strips 95 being interposed therebetween as illustrated in FIG. 20, it is possible to provide ventilation layers 97 between the building structural panels 93 and the external wall panels 96 (see FIG. 23).

More particularly, the ventilation layers 97 are provided in the following manner. When the external wall panels 96 is constructed through horizontal siding work, the vertical furring strips 950 are constructed in longitudinal directions as illustrated in FIG. 22 (A), and when the external wall panels 96 is constructed through vertical siding work, the lateral furring strips 95 are formed on notches 951 and are constructed in vertical directions as illustrated in FIG. 22(B).

With this arrangement, it is possible to obtain ventilation layers 97 wherein air 7 residing between the external wall panels 96 and the building structural panels 93 is reliably released upward. Generation of condensation as explained above can be accordingly prevented since air 7 passes through the ventilation layer 97 as illustrated in FIG. 23. Note that reference numeral 928 in FIGS. 22(A), 22(B) denotes a window frame.

However, the ventilation layer 97 cannot be provided in case the external wall panels 96 are directly fixed to the building framework 92 (see FIG. 24(A)). Since girths 924 of the building framework 92 intercept spaces formed between right and left continuous columns 923 as illustrated in FIG. 24 (B), the passage of air 7 of high temperature and humidity for upward release is blocked thereby (see FIG. 24(A)).

Condensation may be accordingly generated on the external wall panels 96, heat insulators 98 or the building framework 92, which may lead to degradations of durability of the bearing wall owing to corrosion of the building framework 92 or degradations of heat-insulating performance owing to swelling of the heat insulators 98. Penetration of moisture into the interior of the external wall panels 96 will cause gradual degradation of the durability of the panels themselves, and may also cause corrosion of timbers in case the building framework is comprised of timbers.

SUMMARY OF THE INVENTION

The present invention has been made in view of the above problems of the related art, and it is an object of the invention to provide an external wall construction improving workability, waterproof properties, durability and ventilating properties of a bearing wall.

The present invention relates to an external wall construction comprising a building framework of a building and a bearing wall constituted with a plurality of ceramic type external wall panels to be fixed to the building framework, wherein the external wall panels are formed by backing resin sheets on rearward surfaces thereof, and wherein waterproof tapes are interposed between the external wall panels and the building framework.

As explained above, the external wall construction comprises the building framework and the plurality of external wall panels. Thus the external wall construction is simple arrangement and may be easy to be constructed. Decreases in material costs can also be achieved due to the small number of constituents.

Further, since the external wall panels are formed by backing resin sheets on rearward surfaces thereof, water or carbon dioxide will not be absorbed from the rearward surfaces. Accordingly, dimensional changes in the external wall panels can be prevented, and carbonation or neutralization will not be promoted. It is thereby possible to obtain an external wall construction having superior durability.

The provision of resin sheets backed to the external wall panels further serves to prevent generation of cracks or chippings when the panels is face-nailed to the building framework.

Waterproof tapes are interposed between the external wall panels and the building framework. More particularly, the waterproof tapes are interposed between the resin sheets backed on the rearward surfaces of the external wall panels and the framing materials constituting the building framework.

In this manner, penetration of water from between the external wall panels and the building framework can be reliably prevented.

It has also been enabled this arrangement to omit a separate step for constructing the waterproof sheets as it had been necessary in conventional structures for constructing exterior walls, and to thereby achieve further simplification of the external wall construction, and moreover, further simplification of construction.

As explained above, it is possible to provide an external wall construction improving workability, waterproof properties, durability, and ventilating properties of a bearing wall.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
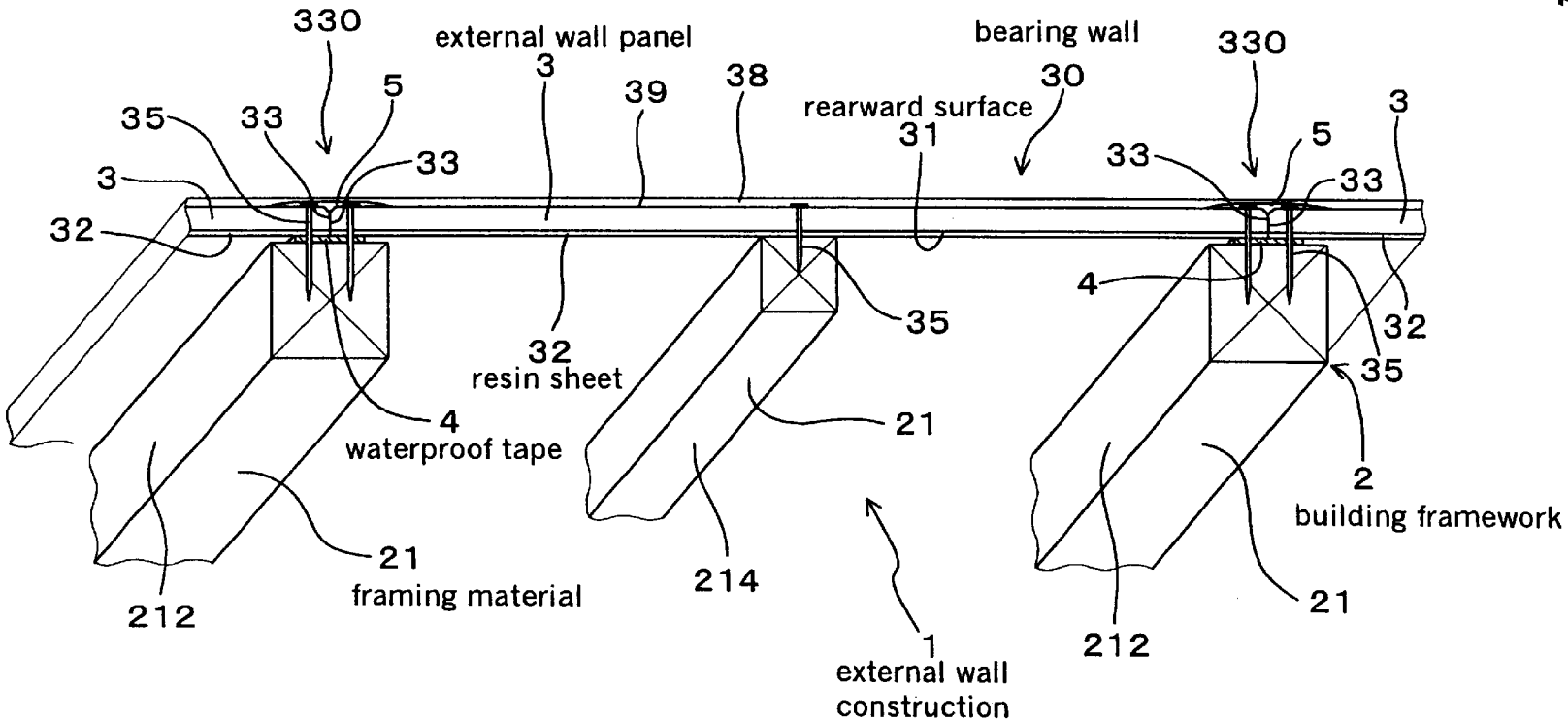
FIG. 1 is a cross-sectional view for explaining the external wall construction according to Embodiment 1.

Hard chip cemented boards, magnesium carbonate boards, wood fiber cemented boards, pulp cemented boards and the like are used as a ceramic type external wall panel.

Examples of the resin sheet are a polyethylene sheet, a foam polyethylene sheet, a polyethylene terephthalate sheet, a vinyl chloride sheet or a vinylidene chloride sheet. The resin sheet may alternatively be sheets made, for example, by overlaying a foam polyethylene sheet on a polyethylene terephthalate sheet, overlaying a foam polyethylene sheet on a paper nonwoven cloth or a polyethylene terephthalate nonwoven cloth, or overlaying a polyethylene sheet on a paper nonwoven cloth or a polyethylene terephthalate nonwoven cloth.

The building framework is constructed of framing materials, for instance, of timbers or glued timbers.

The resin sheets are backed to the external wall panels by means of, for instance, adhesion using adhesives, thermal fusion, or fusing actions using ultrasonic waves or high frequency waves.

One example of methods for constructing the external wall construction according to the present invention will now be explained.

The building framework is assembled using framing materials. Then, the waterproof tapes are adhered to the building framework. A plurality of external wall panels are backed with resin sheets. Thereafter, the plurality of external wall panels are adhered to the waterproof tapes with lateral end portions of the panels abutting against each other. By fixing these panels onto the building framework through face-nailing, the bearing wall is completed.

It is preferable that a thickness of the external wall panels is in a range of 12 to 25 mm. With this arrangement, sufficient strength of the external wall construction can be secured and easy construction can be provided.

If the thickness of the external wall panel is less than 12 mm, it may become necessary to restrict materials that are used as the external wall panels for securing sufficient strength thereof. On the other hand, if the thickness exceeds 25 mm, construction thereof may become difficult.

It is preferable that end portions of the external wall panels are disposed on the framing materials constituting the building framework. With this arrangement, it is possible to obtain an external wall construction having even more superior strength.

It is preferable that the waterproof tapes have elasticity. With this arrangement, penetration of water from between the external wall panels and the building framework can be reliably prevented.

It is preferable that the waterproof tapes closely adhere to the resin sheets backing the external wall panels and the building framework, respectively. More particularly, the waterproof tapes closely adhere to the resin sheets that are backed to the rearward surfaces of the external wall panels and the framing materials constituting the building framework. With this arrangement, penetration of water from between the external wall panels and the building framework can be more reliably prevented.

It is preferable that laterally neighboring external wall panels constituting the bearing wall form butt portions with respective lateral end portions abutted each other, and vertically neighboring external wall panels form shiplap joint portions wherein an upper tongue portion formed at a lower end portion of one panel and a lower tongue portion formed at an upper end portion of another panel are joined together, and covering materials, which comprise elastic joint finishing materials and mesh-like bodies disposed therein, are provided on front surfaces of the butt portions and the shiplap joint portions.

With this arrangement, penetration of water from the butt portions or shiplap joint portions can be reliably prevented while it is enabled to secure sufficient strength of the butt portions and shiplap joint portions. It is further possible to obtain an external wall construction of superior outward design with no joint portions of external wall panels standing out.

It is preferable that a coating material is applied on the front surface of the bearing wall. With this arrangement, it is enabled to obtain an external wall construction of superior outward design. It is also possible to reliably prevent the external wall panels from absorbing water or carbon dioxide, and dimensional changes of the external wall panels and promotion of carbonization or neutralization can be reliably prevented. Thus, it is possible to obtain an external wall construction of more superior durability.

Note that the term "front surface of the bearing wall" denotes a front surface of the bearing wall including also the surface of the above-described covering materials if any covering material should be present.

It is preferable that waterproof tapes are interposed between the rearward surface at peripheral end portions of the external wall panels and the building framework, and notched grooves for ventilation purposes are formed on the girths constituting the building framework and are across surfaces of the girths vertically at which they contact the external wall panels.

As explained above, the external wall constructing structure comprises a building framework and a plurality of external wall panels. Thus, the external wall constructing structure is of simple arrangement and maybe easily constructed. Decreases in material costs can also be achieved due to the small number of constituents. Further, time required for construction can be reduced at worksites.

The external wall constructing structure is capable of increasing effective indoor spaces since thicknesses of that can be kept small except for the thickness of the building framework.

Since the external wall panels are backed with resin sheets on rearward surfaces thereof, water or carbon dioxide is hardly absorbed through the rearward surfaces. With this arrangement, no dimensional changes of the external wall panels will be generated and carbonization and neutralization will not be promoted. Thus, it is possible to obtain an external wall construction having superior durability.

The backing of the resin sheets on the external wall panels will prevent generation of cracks or chippings when these panels are face-nailed to the building framework.

The waterproof tapes are interposed between the rearward surface at peripheral end portions of the external wall panels and the building framework. More particularly, the waterproof tapes are interposed between the resin sheets backed on the rearward surfaces of the external wall panels and the building framework.

With this arrangement, penetration of water from between the external wall panels and the building framework can be reliably prevented.

This arrangement further eliminates the necessity of separately constructing the waterproof sheets as it has been necessary in conventional external wall constructing structures, and it can be achieved for further simplification of the external wall construction and thus for further simplification of construction.

The girths of the building framework are formed with notched grooves for ventilation purposes on surfaces contacting the external wall panels. It is thereby enabled to secure ventilation of the interior of the external wall panels.

With this arrangement, it is possible to prevent air of high temperature and humidity in the interior of a building from condensing on rearward surfaces of the external wall panels or peripheries thereof. Thus, corrosion and other damages on the building framework can be prevented and an exterior wall construction structure having superior durability can be obtained.

The notched grooves are formed to face vertical directions when the girths are assembled as framings of the building framework. That is, the notched portions are formed in directions perpendicular to the length direction of the girths.

Either a single or a plurality of notched grooves may be formed per each width of a single external wall panel.

Peripheral end portions of the external wall panel specify regions up to, for instance, approximately 30 mm inward of four sides in vertical and lateral directions of the external wall panel. Further, when the external wall panels are face-nailed as it will be explained hereinafter, nails are driven into the peripheral end portions at regions inward of the four sides in vertical and lateral directions by 15 to 30 mm. More preferably, face-nailing is performed at portions inward of the four sides of the external wall panel by up to 20 mm.

One example of methods for constructing the external wall constructing structure of the present invention will now be explained.

First, the building framework is constructed of timbers or the like. Then, waterproof tapes are adhered to portions of the building framework. The portions are where the peripheral end portions of the rearward surfaces of the external wall panels abut against the building framework. Then, a plurality of external wall panels preliminarily backed with resin sheets are adhered to the waterproof tapes with their end portions abutted each other. These panels are fixed onto the building framework through face-nailing to obtain a bearing wall.

It is preferable that a thickness of the external wall panels is in a range of 12 to 25 mm. With this arrangement, sufficient strength of the external wall construction can be secured and easy construction can be provided.

If the thickness of the external wall panel is less than 12 mm, it may become necessary to restrict materials that are used as the external wall panels for securing sufficient strength thereof. On the other hand, if the thickness exceeds 25 mm, construction thereof may become difficult.

It is preferable that rearward surfaces at the peripheral end portions of the external wall panels are disposed on the building framework, and that the peripheral end portions are fixed onto the building framework through face-nailing at specified pitches. With this arrangement, it is possible to obtain an external wall construction having even more superior strength.

It is preferable that the specified pitch is in a range of 50 to 150 mm. In case the pitch is less than 50 mm, damages of base materials may be caused at peripheries of face-nailing portions on front and rearward surfaces of the external wall panels. On the other hand, in case the pitch exceeds 150 mm, it will become difficult to form the bearing wall.

It is preferable that the waterproof tapes have elasticity. With this arrangement, penetration of water can be reliably prevented by reliably closing slight clearances formed between the external wall panels and the building framework and closely adhering there.

It is preferable that the waterproof tapes closely adhere to the resin sheets of the external wall panels and the building framework, respectively. More particularly, the waterproof tapes closely adhere to the resin sheets that are backed to the rearward surfaces of the external wall panels and the framing materials constituting the building framework, respectively. With this arrangement, penetration of water from between the external wall panels and the building framework can be more reliably prevented.

It is preferable that laterally neighboring external wall panels constituting the bearing wall form butt portions with respective lateral end portions being abutted to each other, and vertically neighboring external wall panels form shiplap joint portions wherein an upper tongue portion formed at a lower end portion of one panel and a lower tongue portion formed at an upper end portion of another panel are joined together, and covering materials, which comprise elastic joint finishing materials and mesh-like bodies disposed therein, are provided on front surfaces of the butt portions and the shiplap joint portions. With this arrangement, penetration of water from the butt portions or shiplap joint portions can be reliably prevented while it is enabled to secure sufficient strength of the butt portions and shiplap joint portions. It is further possible to obtain an external wall construction of superior outward design with no joint portions of external wall panels standing out.

Figure 5:
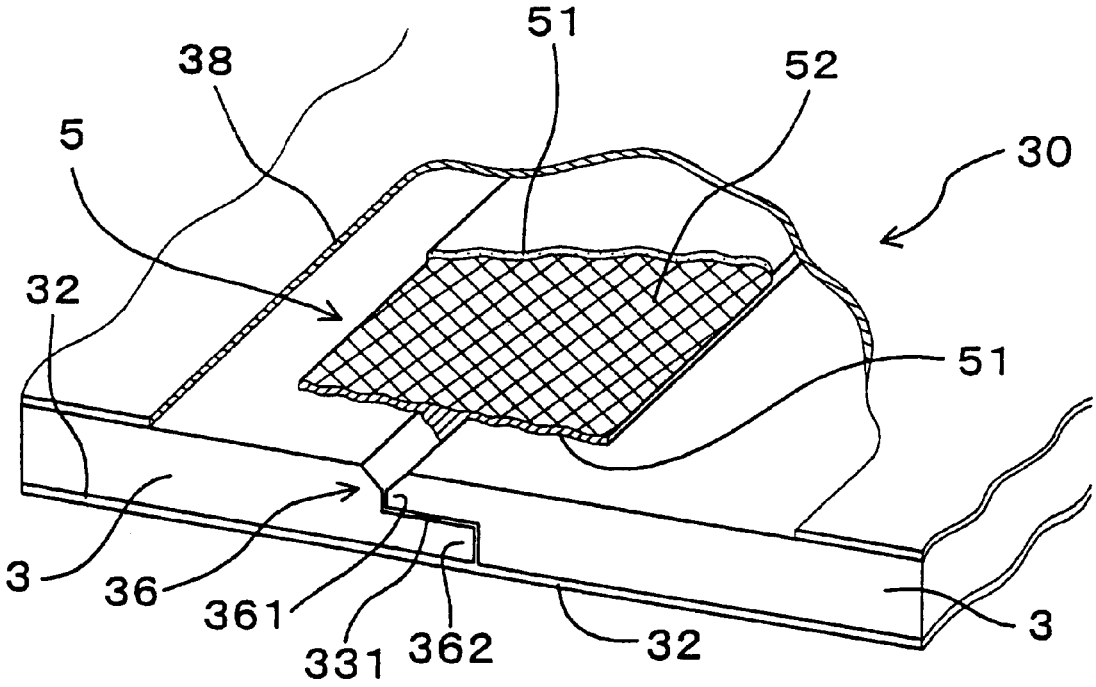
FIG. 5 is an explanatory view of a covering material according to Embodiment 1.

Note that the term "front surface of the shiplap joint portion" denotes a front surface of the external wall panels at which end portions on the surface side of the panels are abutted (reference numeral 36 in FIG. 5).

It is preferable that a coating material is applied on the front surface of the bearing wall. With this arrangement, it is enabled to obtain an external wall construction of superior outward design. It is also possible to prevent reliably the external wall panels from absorbing water or carbon dioxide, and accordingly dimensional changes of the external wall panels and promotion of carbonization or neutralization can be reliably prevented. Thus, it is possible to obtain an external wall construction of more superior durability.

Note that the term "front surface of the bearing wall" denotes a front surface of the bearing wall including also the surface of the above-described covering materials if any covering material is present.

It is preferable that lateral surfaces of continuous columns constituting the building framework fix supporting columns. Therefore, the continuous columns can be reinforced. Thereby strength of the building framework is secured.

It is preferable that the continuous columns and the supporting column are of identical sectional dimensions. With this arrangement, further decreases in construction costs can be achieved.

It is preferable that the end portions of the girths are fixed to upper ends of the supporting columns. More particularly, the girths may be fixed in conditions in which their end portions are mounted on upper ends of the supporting columns. With this arrangement, the girths can be easily and reliably fixed to the continuous columns through the supporting columns.

It is preferable that the notched grooves have a depth of 10 to 30 mm and a width of 3 to 150 mm. With this arrangement, ventilation of the interior of the external wall panels can be reliably performed while strengths of the building framework can be secured.

In case the depth of the notched groove is less than 10 mm, it may be that ventilation cannot be performed sufficiently. On the other hand, if the depth exceeds 30 mm, strengths of the girths are degraded and it may happen that sufficient strength of the building framework cannot be secured.

In case the width of the notched groove is less than 3 mm, ventilation may not be performed sufficiently. On the other hand, in case the width exceeds 150 mm, it may be that face-nailing cannot be performed at pitches required for forming the bearing wall.

It is preferable that convex streak portions formed between neighboring notched grooves have a width of 60 to 400 mm. With this arrangement, ventilation in the interior of the external wall panels can be reliably performed simultaneously with securing strength of the building framework. Face-nailing at pitches required for forming the bearing wall will also become easy.

In case the width of the convex streak portions is less than 60 mm, contact areas between the girths and the external wall panels will be too small such that strength of the external wall construction may not be secured. It may also cause difficulties in face-nailing when the external wall panels are fixed to the girths through face-nailing.

On the other hand, in case the width of the convex streak portions exceeds 400 mm, ventilation may not be performed in a satisfactory manner.

It is preferable that the external wall panels are face-nailed to the convex streak portions of the girths. With this arrangement, the external wall panels can be easily and reliably fixed to the girths.

EMBODIMENTS

Embodiment 1

The external wall construction according to one embodiment of the present invention will now be explained based on FIGS. 1 to 5.

Figure 2:
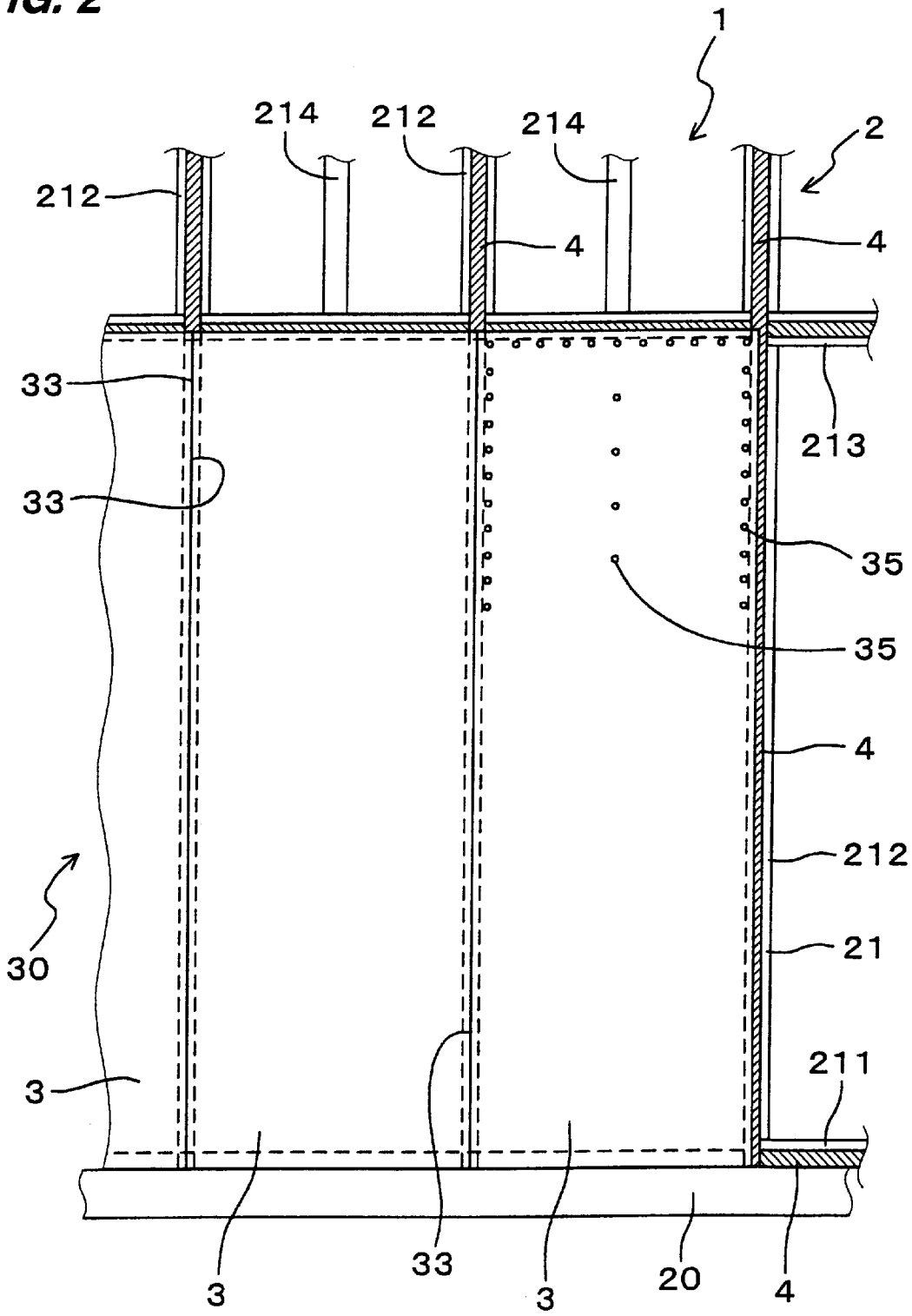
FIG. 2 is a front view of the external wall construction according to Embodiment 1.

The external wall construction 1 according to the present embodiment as illustrated in FIGS. 1 and 2 is arranged as a bearing wall 30 comprised by fixing a plurality of ceramic type external wall panels 3 to a building framework 2 of a building.

Figure 4:
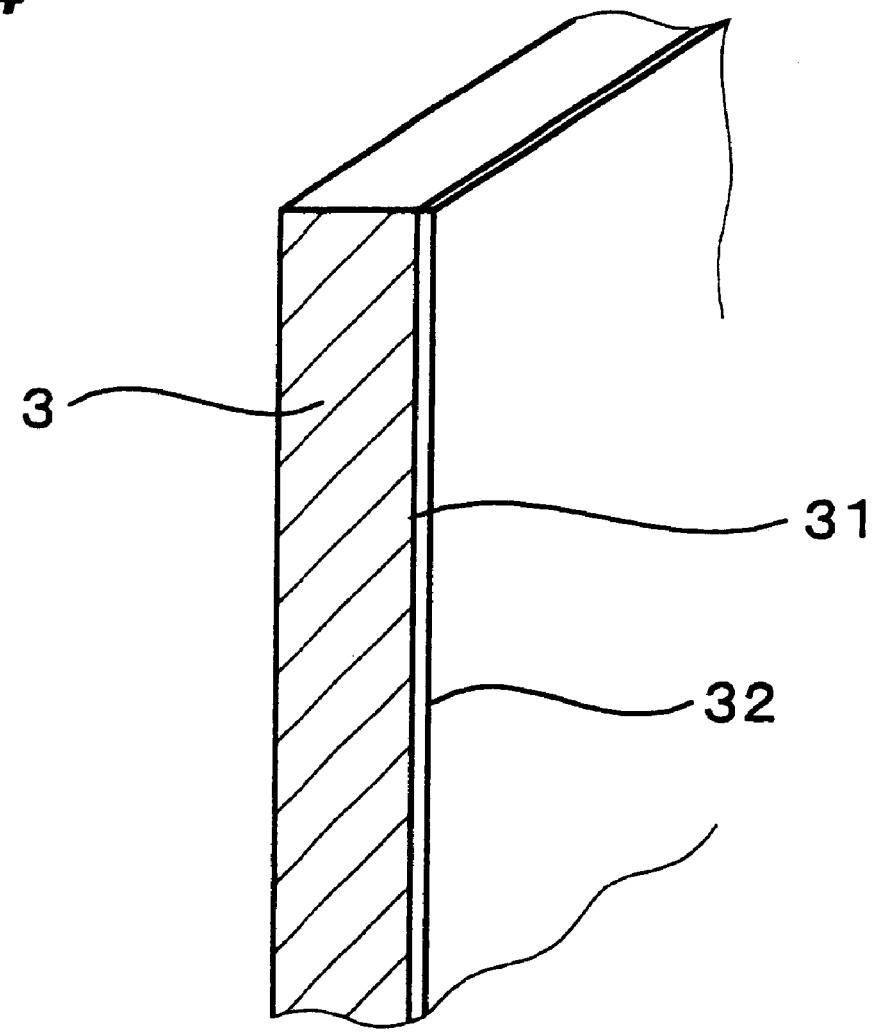
FIG. 4 is an explanatory view of a external wall panel according to Embodiment 1.

As illustrated in FIG. 4, a rearward surface 31 of each external wall panel 3 is backed with a resin sheet 32. Waterproof tapes 4 are further interposed between the external wall panels 3 and the building framework 2 as illustrated in FIGS. 1 and 2.

Hard chip cemented boards are employed as the external wall panels 3 and polyethylene sheets are employed as the resin sheets 32.

The building framework 2 is constructed of framing materials 21 made of timbers.

The resin sheets 32 are backed to the external wall panels 3 through fusion using a laminator.

The thickness of the external wall panels 3 is approximately 25 mm while the thickness of the resin sheets 32 is approximately 0.5 mm.

Figure 3:
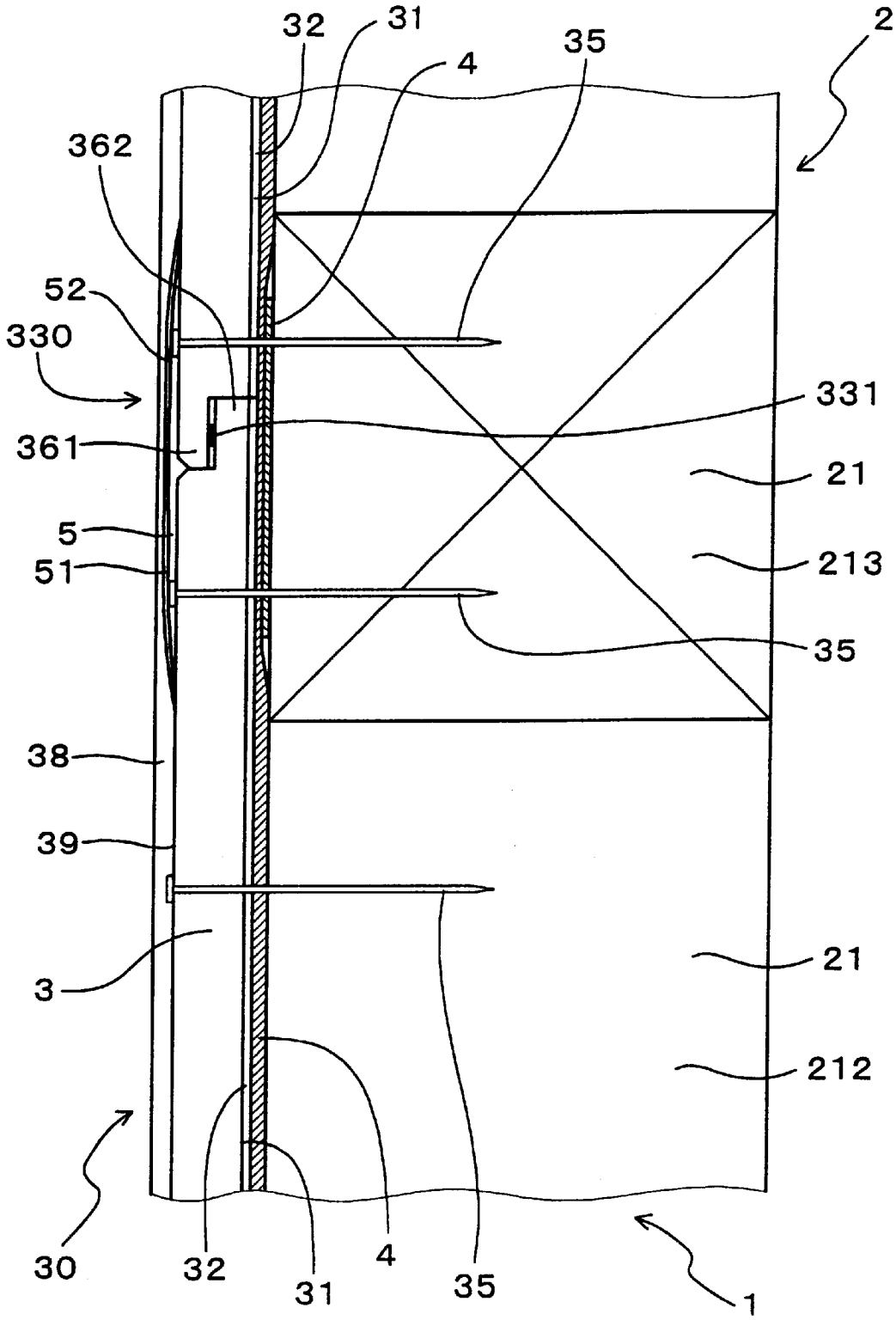
FIG. 3 is a longitudinal sectional view for explaining the external 11 construction according to Embodiment 1.

As illustrated in FIGS. 1 and 3, the external wall construction 1 is constructed such that lateral end portions 33, upper end portions (lower tongue portions 362) and lower end portions (upper tongue portions 361) of each external wall panel 3 are disposed on the framing materials 21 constituting the building framework 2.

The waterproof tapes 4 have elasticity and closely adhere closely to the resin sheets 32 of the external wall panels 3 and the building framework 2, respectively. More particularly, the waterproof tapes 4 adhere closely to both, the resin sheets 32 backed on the rearward surfaces 31 of the external wall panels 3 and the framing materials 21 constituting the building framework 2.

As illustrated in FIG. 1, laterally neighboring external wall panels 3 constituting the bearing wall 30 form butt portions 330 with respective lateral end portions 33 being abutted to each other. Further , as illustrated in FIG. 3, vertically neighboring external wall panels 3 form shiplap joint portions 36 with an upper tongue portion 361 formed at a lower end portion of one panel and a lower tongue portion 362 formed at an upper end portion of another panel being joined through straight scarf joint. As illustrated in FIG. 5, covering materials 5, which comprise elastic joint finishing materials 51 and mesh-like bodies 52 disposed therein, are provided on front surfaces of the butt portions 330 and the shiplap joint portions 36.

As illustrated in FIGS. 1 and 3, a coating material 38 is applied on the front surface 39 of bearing wall 30. More particularly, the coating material 38 is applied over the entire front surface 39 of the bearing wall 30 including also the surface of the covering materials 5. Note that elastic caulking materials 331 are preliminarily installed to the lower tongue portions 362 formed at upper end portions of the lower external wall panels 3 of the shiplap joint portions 36.

Constructing methods of the external wall construction 1 of the present embodiment will now be explained.

As illustrated in FIG. 2, the building framework 2 is first assembled through framing materials 21 made of timbers. More particularly, the building framework 2 is assembled onto a foundation 20 using framing materials 21 as a base 211, continuous columns 212, girths 213, and studs 214.

Thereafter, the waterproof tapes 4 are adhered to framing materials 21 as the continuous columns 212 and girths 213. A plurality of external wall panels 3 preliminarily backed with resin sheets 32 (see FIG. 3) is then adhered to the waterproof tapes 4 by abutting lateral end portions 33 of the panels to each other. The bearing wall 30 is completed by fixing the external wall panels 3 to the building framework 2 by driving nails 35 into the building framework 2 from above the external wall panels 3 (see FIG. 1).

The covering materials 5 are further provided on the shiplap joint portions 36 of the external wall panels 3 as illustrated in FIG. 5.

Thereafter, the coating material 38 is applied onto the entire front surface 39 of the bearing wall 30 as illustrated in FIGS. 3 and 5.

Actions and effects of the present embodiment will now be explained.

As explained above, the external wall construction 1 comprises the building framework 2 and the plurality of external wall panels 3. Thus, the external wall construction 1 has simple arrangement and may be easy to be constructed. Decreases in material costs can also be achieved due to the small number of constituents.

Figure 21:
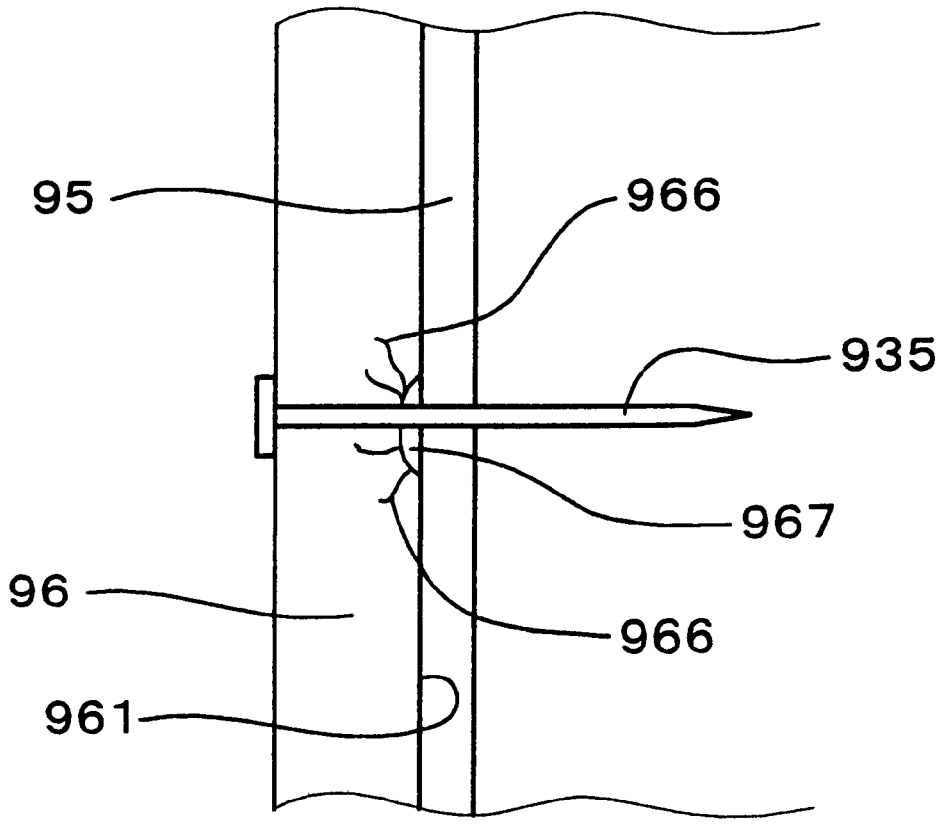
Prior Art Fig. 21
FIG. 21 is an explanatory view of face-nailing portions of a conventional external wall panel.
Figure 22A:
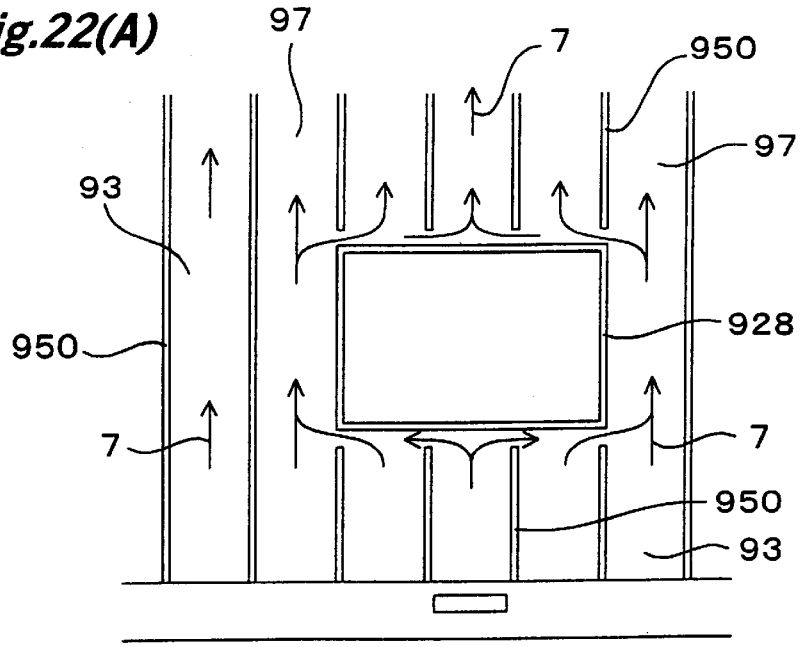
Prior Art Fig.22(A)
FIGS. 22(A) and 22(B) are explanatory views of furring strips and ventilation layers of a conventional external wall panel.
Figure 22B:
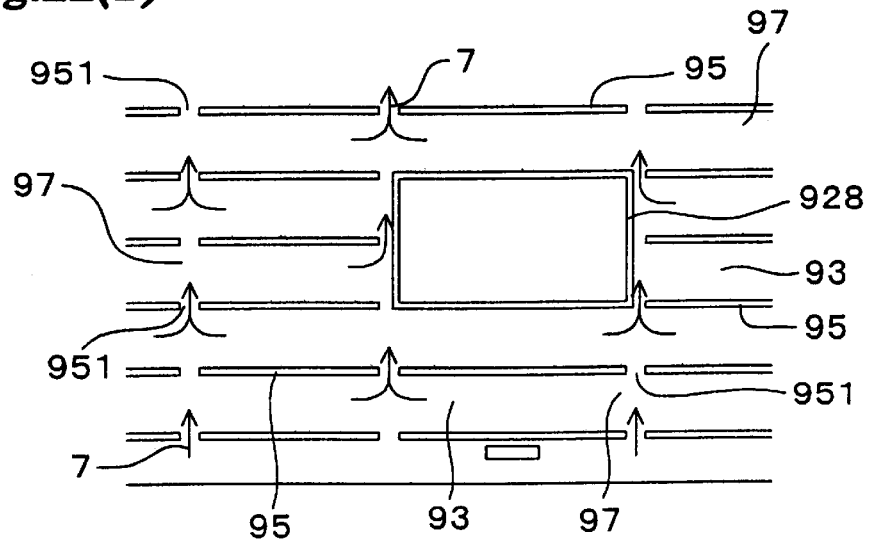
Prior Art Fig.22(B)
Figure 23:
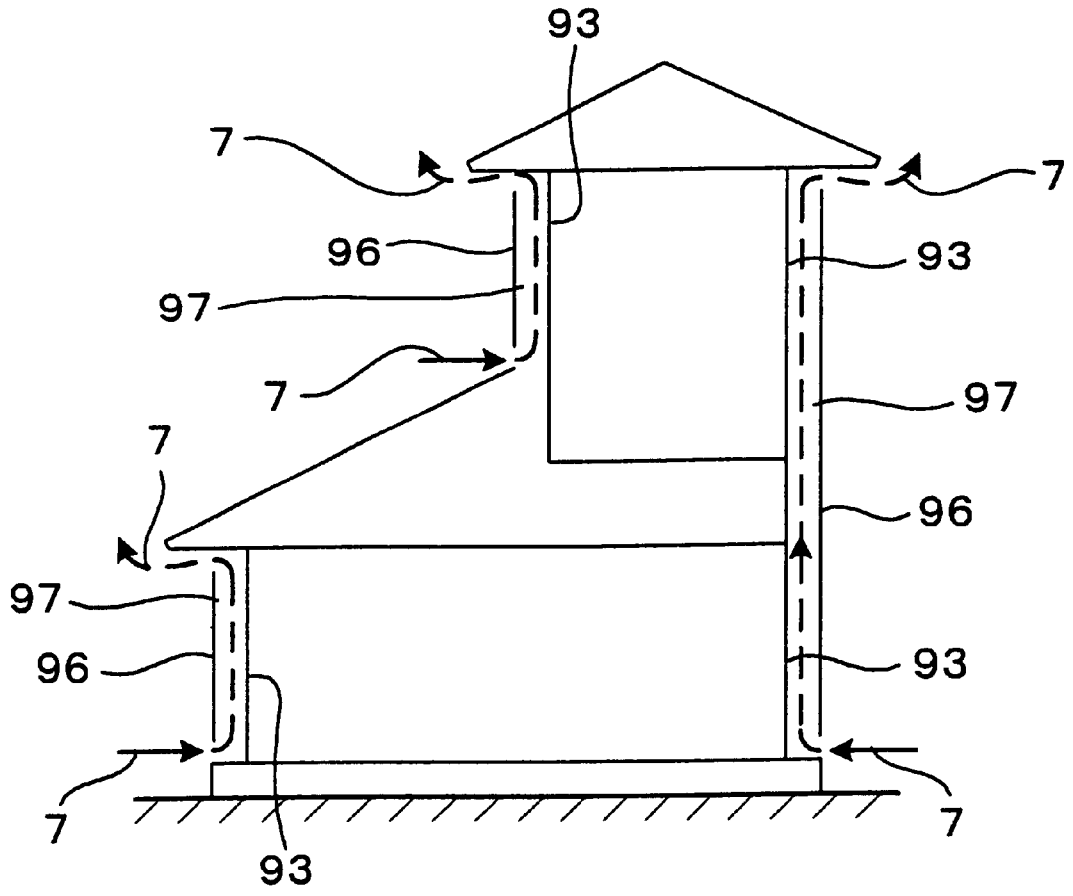
Prior Art Fig. 23
FIG. 23 is an explanatory view of ventilation layers of a conventional external wall panel.
Figure 24A:
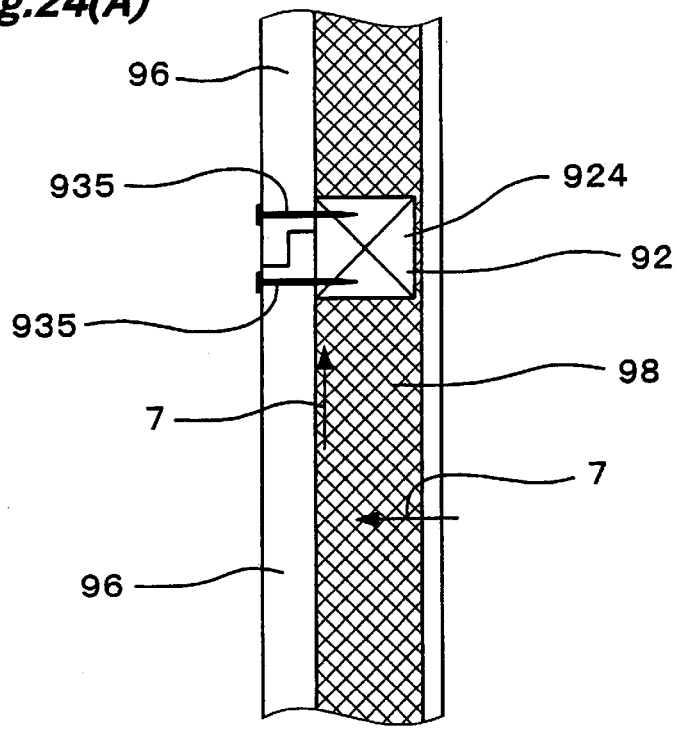
Prior Art Fig.24(A)
FIG. 24(A) is a sectional explanatory view for explaining problems of a conventional external wall construction when external wall panels are directly fixed to a building framework.
Figure 24B:
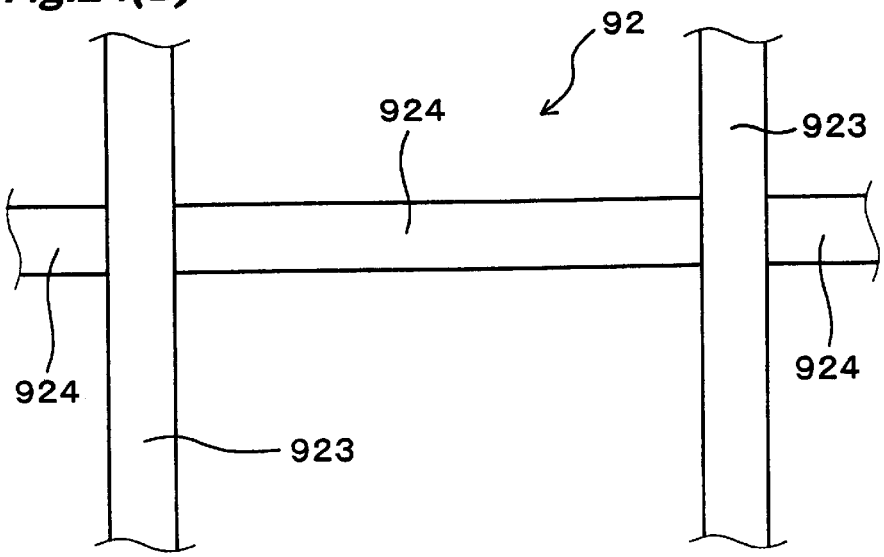
Prior Art Fig.24(B)
FIG. 24(B) is an explanatory view of the building framework.

Further, since the external wall panels 3 are formed by backing resin sheets 32 on rearward surfaces 31 thereof, cracks or chippings (see FIG. 21) of the rearward surfaces 31 of the external wall panels 3 caused through face-nailing can be prevented. Accordingly, water or carbon dioxide will not be absorbed from the cracks or chippings formed on the rearward surfaces 31 so that no dimensional changes of the external wall panels 3 will be caused, and carbonation or neutralization will not be promoted. It is thereby possible to obtain an external wall construction 1 of superior durability.

Waterproof tapes 4 are interposed between the external wall panels 3 and the building framework 2. More particularly, the waterproof tapes 4 are interposed between the resin sheets 32 backed on the rearward surfaces 31 of the external wall panels 3 and the framing materials 21 constituting the building framework 2 (see FIGS. 1 and 3).

In this manner, penetration of water from between the external wall panels 3 and the building framework 2 on the butt portions 330 or rearward surfaces of shiplap joint portions 36 can be reliably prevented.

Figure 19:
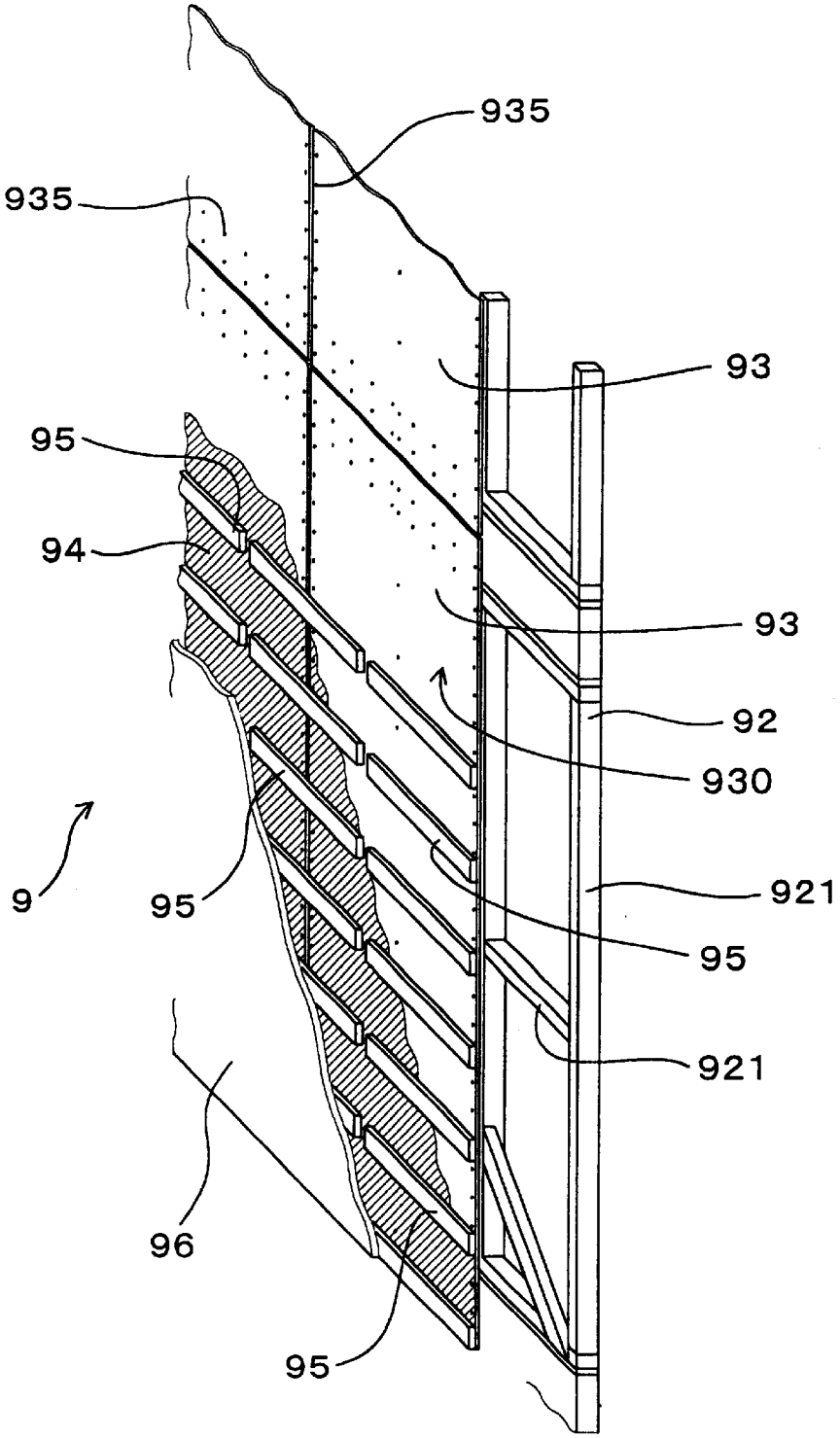
Prior Art Fig. 19
FIG. 19 is Explanatory view of a conventional external wall construction.
Figure 20:
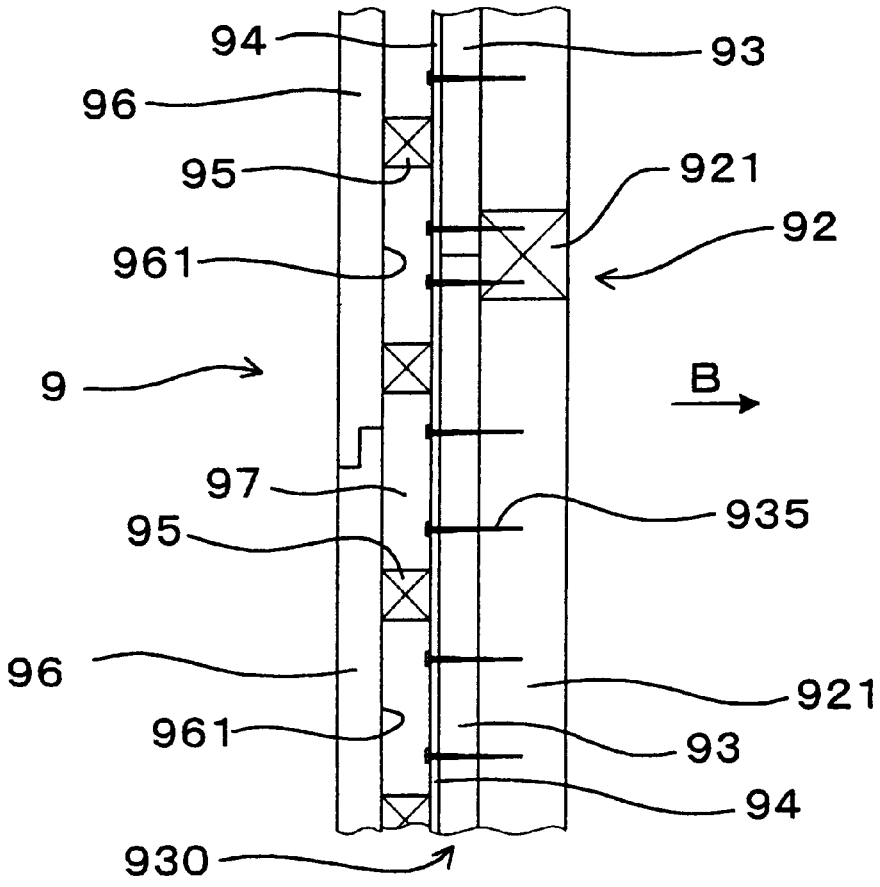
Prior Art Fig. 20
FIG. 20 is a sectional view for explaining a conventional external wall construction.

It has also been enabled with this arrangement to omit a separate step for constructing waterproof sheets (reference numeral 94 in FIGS. 19 and 20) as it had been necessary in conventional structures for constructing exterior walls. Thereby further simplification of the external wall construction 1 and, moreover, further simplification of construction are achieved.

The external wall panels 3 has a thickness of approximately 25 mm, thereby a sufficient strength of the external wall construction 1 can be secured while further making constructions easy.

By the arrangement of directly disposing the lateral end portions 33 of the external wall panels 3 onto the framing materials 21 constituting the building framework 2, an external wall construction 1 of more superior strength can be obtained.

Since the waterproof tapes 4 have elasticity, close contact between the external wall panels 3 and the building framework 2 can be achieved and thereby penetration of water from clearances formed between these members is prevented reliably.

Laterally neighboring external wall panels 3 constituting the bearing wall 30 form butt portions 330, and vertically neighboring external wall panels 3 form shiplap joint portions 36. Covering materials 5 are provided on front surfaces of the butt portions 330 and the shiplap joint portions 36 (see FIG. 5).

With this arrangement, penetration of water from the butt portions 330 or shiplap joint portions 36 can be reliably prevented while it is enabled to secure sufficient strength of the shiplap joint portions 36. It is further possible to obtain an external wall construction 1 of superior outward design with no joint portions of external wall panels 3 standing out.

Since the coating material 38 is applied on the front surface 39 of the bearing wall 30, it is enabled to obtain an external wall construction 1 of superior outward design. It is also possible to prevent reliably the external wall panels 3 from absorbing water or carbon dioxide from the rearward surfaces 31 of the panels, and dimensional changes of the external wall panels 3 and promotion of carbonization or neutralization can be reliably prevented. Thus, it is possible to obtain an external wall construction 1 of more superior durability.

As explained so far, the present embodiment is capable of providing an external wall construction improving workability, waterproof properties and durability of a bearing wall.

Embodiment 2

Figure 6:
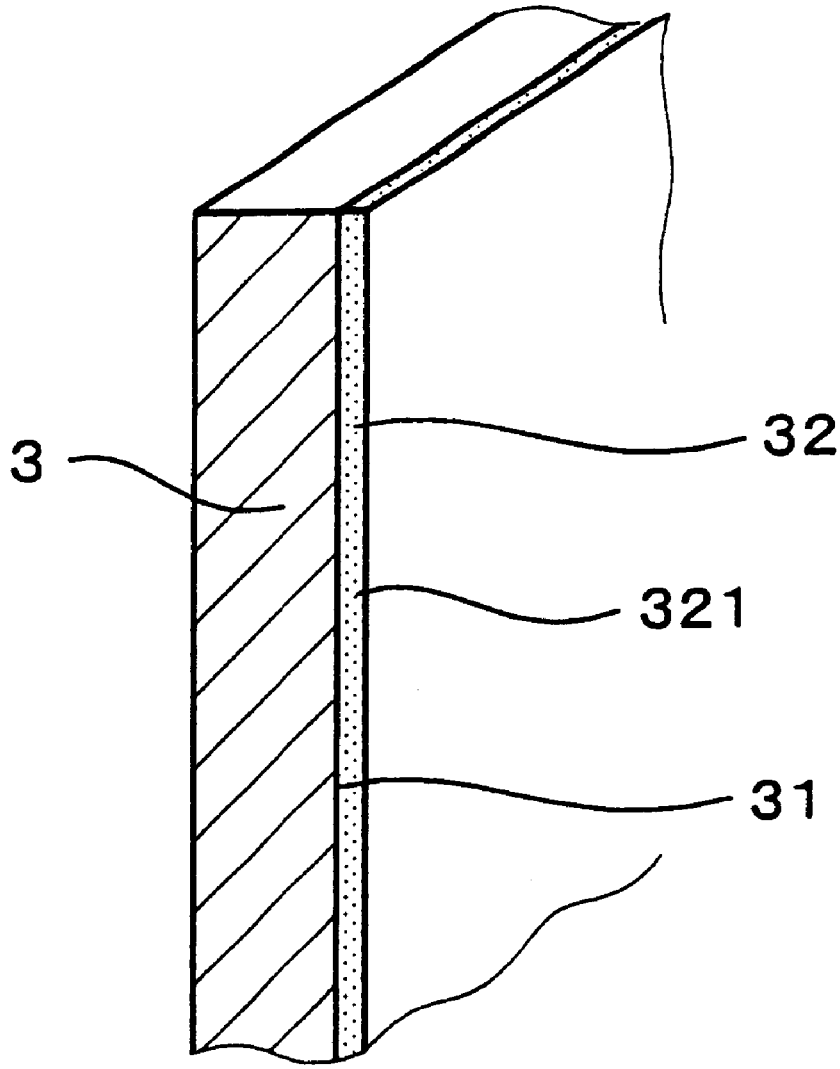
FIG. 6 is an explanatory view of a external wall panel according to Embodiment 2.

The present embodiment is an example employing foam polyethylene sheets 321 as the resin sheets 32 to be backed to the ceramic type external wall panels 3 as illustrated in FIG. 6.

The thickness of the resin sheets 32 is approximately 2.0 mm.

The remaining arrangements are identical to those of Embodiment 1.

The resin sheets 32 of this example have remarkable elasticity since the resin sheets 32 are foamed bodies (closed-cell structures). Thus, adhesion with the waterproof tapes 4 interposed between the building framework 2 and the external wall panels 3 may be performed in a more reliable manner.

Thus, it is possible to obtain an external wall construction of more superior waterproof properties.

The external wall construction of the present embodiment have extremely high resistance to impact applied through face-nailing so that cracks or chippings formed on rearward surfaces 31 of the external wall panels 3 can be more reliably prevented.

The present embodiment further have actions and effects identical to those of Embodiment 1.

Embodiment 3

Figure 7:
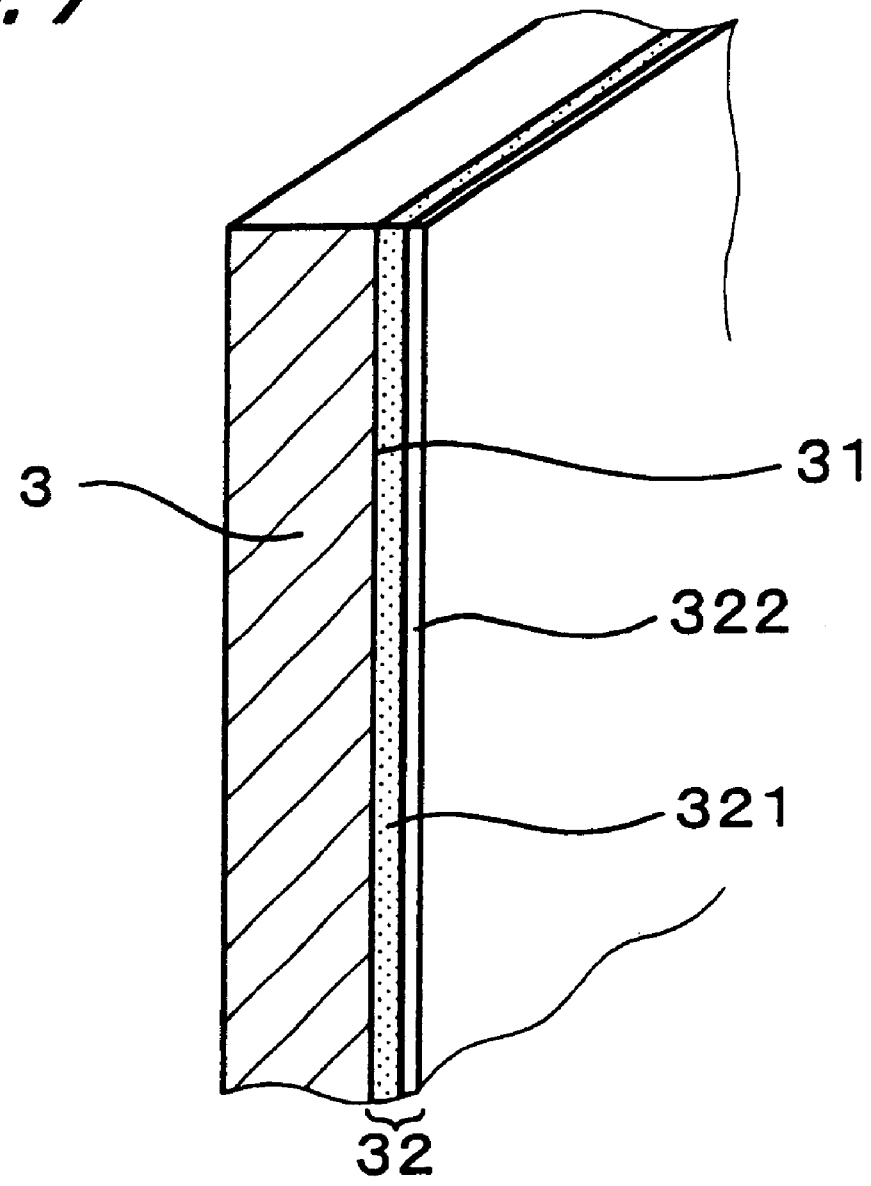
FIG. 7 is an explanatory view of a external wall panel according to Embodiment 3.

In this embodiment, the resin sheets 32 to be backed to the ceramic type external wall panels 3 are obtained by overlaying foam polyethylene sheets 321 and polyethylene terephthalate nonwoven cloths 322, as illustrated in FIG. 7.

More particularly, the foam polyethylene sheets 321 are backed to the rearward surfaces 31 of the external wall panels 3, whereon the polyethylene terephthalate nonwoven cloths 322 are backed as illustrated in FIG. 7.

The thickness of the resin sheets 32 is approximately 1.5 mm.

The remaining arrangements are identical to those of Embodiment 1.

In this arrangement, each resin sheet 32 comprises laminated foam layer and resin layer. Therefore, the mechanical strength of the sheets as backing materials is substantially improved.

Accordingly, it is possible to obtain an external wall construction having even superior waterproof properties and durability.

The present embodiment further have actions and effects identical to those of Embodiment 1.

Embodiment 4

The external wall construction according to embodiment 4 of the present invention will now be explained based on FIGS. 8 to 13.

Figure 8:
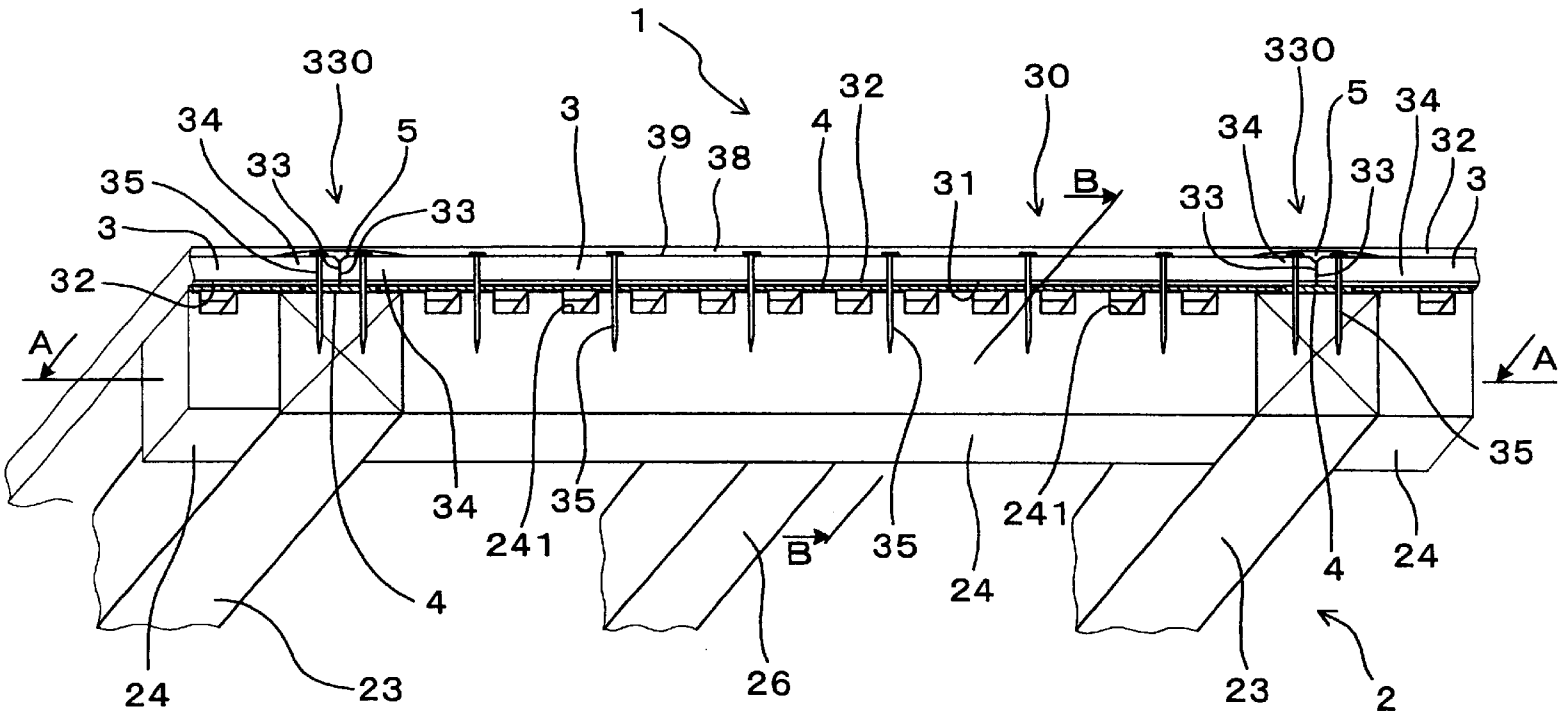
FIG. 8 is a cross-sectional perspective view of the external wall construction according to Embodiment 4.
Figure 9:
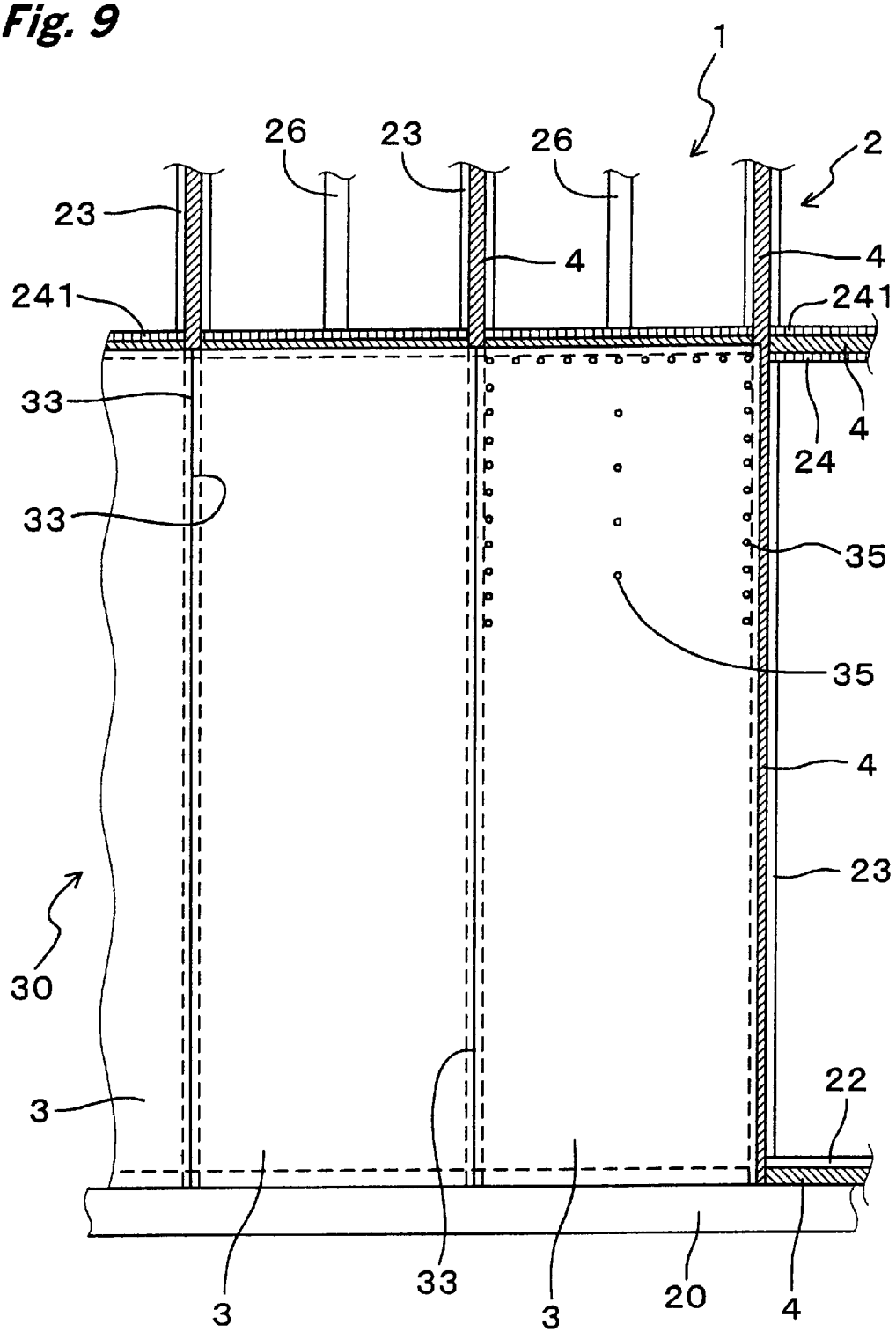
FIG. 9 is a front view of the external wall construction according to Embodiment 4.

As illustrated in FIGS. 8 and 9, the external wall construction 1 according to the present embodiment is arranged, wherein a bearing wall 30 is constructed by fixing a plurality of ceramic type external wall panels 3 to a building framework 2 of a building. The building framework 2 is comprised of a base 22, continuous columns 23, girths 24, and studs 26.

Each external wall panel 3 is arranged by backing a resin sheet 32 on a rearward surface 31 of the panel (see FIG. 4). Further, waterproof tapes 4 are interposed between rearward surfaces 31 of the external wall panels 3 at peripheral end portions 34 thereof and the building framework 2 as illustrated in FIGS. 8 and 9.

Figure 11:
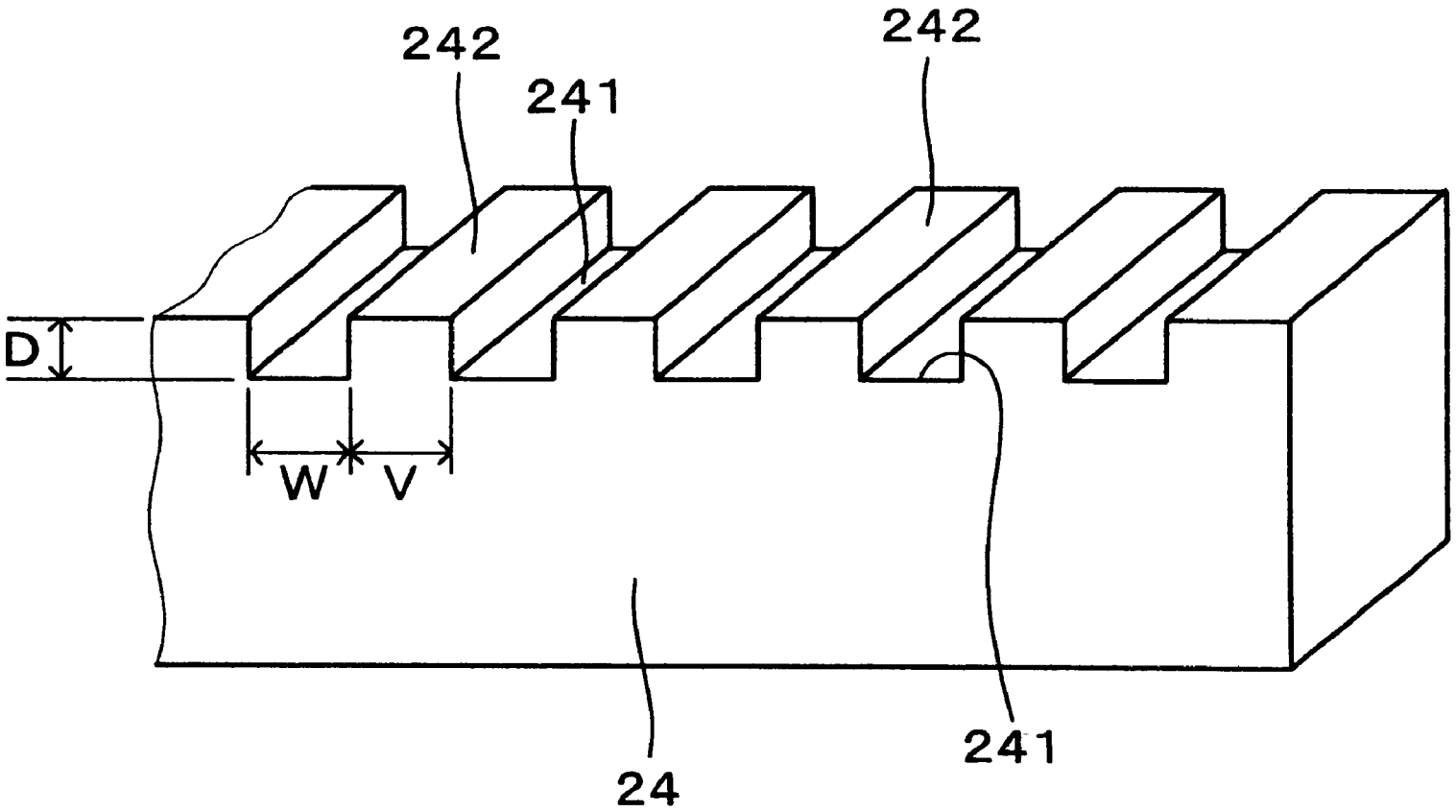
FIG. 11 is a perspective view of a girth according to Embodiment 4.

The girths 24 become framing materials in horizontal directions as illustrated in FIG. 9, with a plurality of notched grooves 241 for ventilation purposes being formed on surfaces of the girths contacting the rearward surfaces 31 of the external wall panels 3 as to be across in vertical directions as illustrated in FIGS. 8 and 11.

Hard chip cemented boards are employed as the external wall panels 3. Polyethylene sheets are used as the resin sheets 32 and are backed to the external wall panels 3 through fusion using a laminator.

The thickness of the external wall panels 3 is approximately 15 mm while the thickness of the resin sheets 32 is approximately 0.5 mm.

Figure 10:
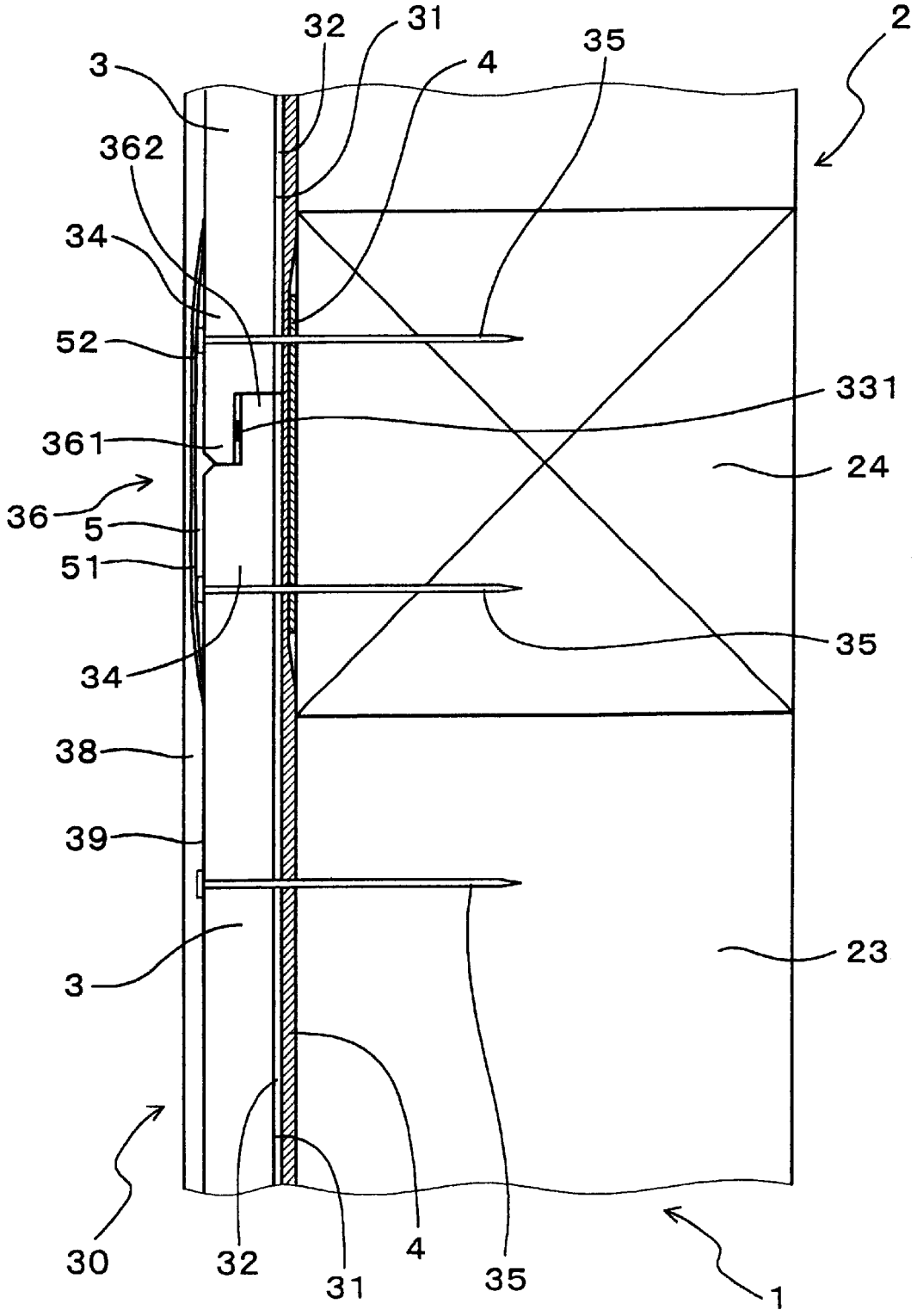
FIG. 10 is a longitudinal sectional view for explaining the external wall construction according to Embodiment 4.

As illustrated in FIGS. 8, the external wall construction 1 is constructed such that lateral end portions 33 of laterally arranged external wall panels 3 are disposed on the continuous columns 23 constituting the building framework 2. As illustrated in FIG. 10, the joint portions of the vertically arranged external wall panels 3 are arranged such that a lower tongue portion 362 formed on an upper end portion of a lower panel and an upper tongue portion 361 formed on a lower end portion of an upper panel are disposed on the girths 24.

The waterproof tapes 4 exhibit elasticity and are closely adhering to the resin sheets 32 backed to the rearward surfaces 31 of the external wall panels 3 and the base 22, continuous columns 23, and the girths 24, respectively, as illustrated in FIG. 9. With this arrangement, the rearward surfaces 31 of the external wall panels 3 are closely adhered to the building framework 2 at peripheral end portions 34 of the panels.

Further, as illustrated in FIG. 11, a plurality of notched grooves 241 is formed on one lateral surface of each girth 24 in directions perpendicular to the length direction of the girth 24.

The girths 24 are assembled to the continuous columns 23 such that lateral surfaces with the notched grooves 241 formed on the girths 24 facing to the side to which the external wall panels 3 are fixed, that is, to the outdoor side, as illustrated in FIG. 8.

Figure 12A:
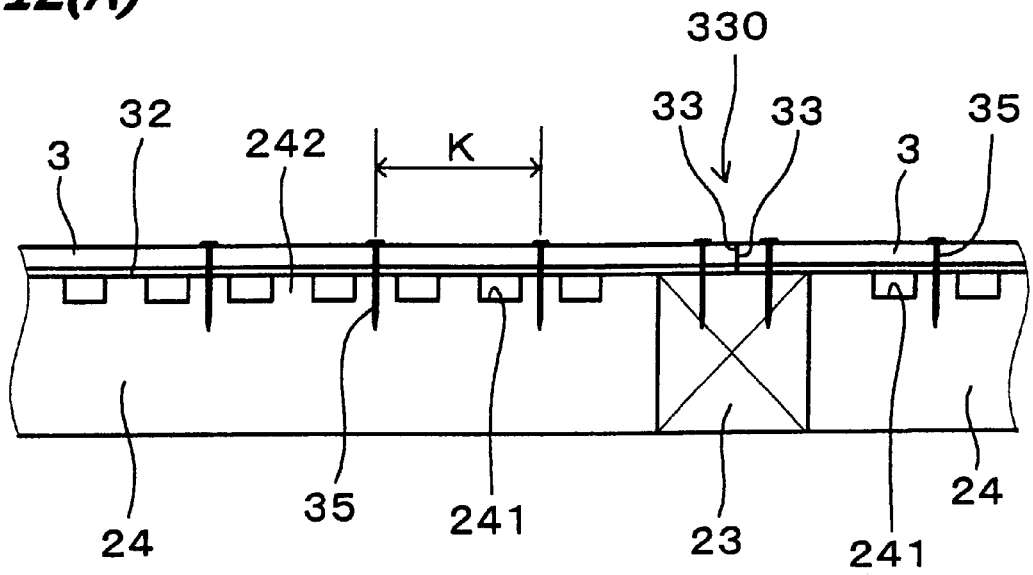
FIG. 12(A) is a sectional view seen from a direction as indicated by the arrow from line A—A of FIG. 8.
Figure 12B:
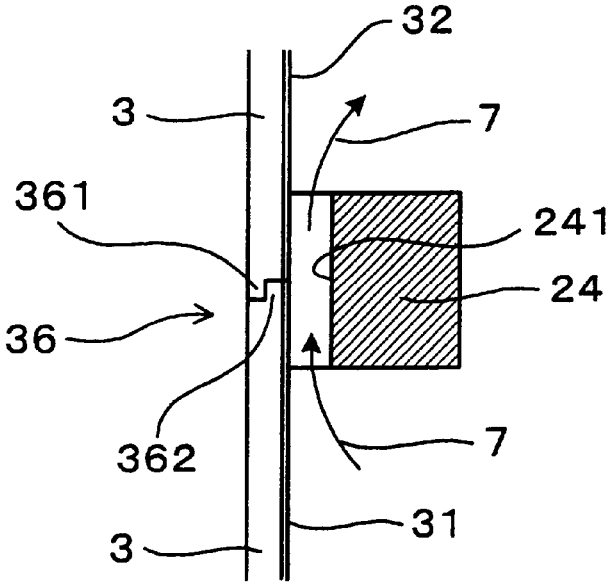
FIG. 12(B) is a sectional view seen from a direction as indicated by the arrow from line B—B of FIG. 8.

Therefore, ventilation paths through which air 7 is released are formed in vertical directions between the rearward surfaces 31 of the external wall panels 3 and the notched grooves 241 (see FIGS. 8, 12(A) and 12(B)).

For instance, it is assumed that in the girth 24 of FIG. 11, each notched groove 241 has a depth D of 15 mm, and a width W of 25 mm while each convex streak portion 242 formed between neighboring notched grooves 241 has a width V of 25 mm.

As illustrated in FIG. 12(A), the external wall panels 3 are face-nailed to the girths 24 at the convex streak portions 242. Intervals for driving the nails 35 are set to be 100 mm for forming the bearing wall 30.

Further, as illustrated in FIGS. 8 and 12(A), laterally neighboring external wall panels 3 constituting the bearing wall 30 form butt portions 330 with respective lateral end portions 33 being abutted to each other. Further, vertically neighboring external wall panels 3 form shiplap joint portions 36 with an upper tongue portion 361 formed at a lower end portion of one panel and a lower tongue portion 362 formed at an upper end portion of another panel being joined through straight scarf joint, as illustrated in FIG. 10. Covering materials 5, which are comprised of elastic joint finishing materials 51 and mesh-like bodies 52 disposed therein, are provided on front surfaces of the butt portions 330 and the shiplap joint portions 36 (see FIG. 5).

Coating material 38 is applied on the front surface 39 of bearing wall 30 as illustrated in FIGS. 8 and 10. More particularly, the coating material 38 is applied over the entire front surface 39 of the bearing wall 30 including also the surface of the covering materials 5. Note that elastic caulking materials 331 are preliminarily installed to the lower tongue portions 362 formed at upper end portions of the lower external wall panels 3 of the shiplap joint portions 36. By overlapping the upper tongue portions 361 onto the lower tongue portions 362, the elastic caulking materials 331 are pressed and deformed and thereby joint of the vertically arranged external wall panels 3 is performed reliably.

Constructing methods of the external wall construction 1 of the present embodiment will now be explained.

As illustrated in FIG. 9, the building framework 2 is first assembled from timbers. More particularly, the building framework 2 is obtained by assembling a base 22, continuous columns 23, girths 24, and studs 26 onto a foundation 20.

Figure 13:
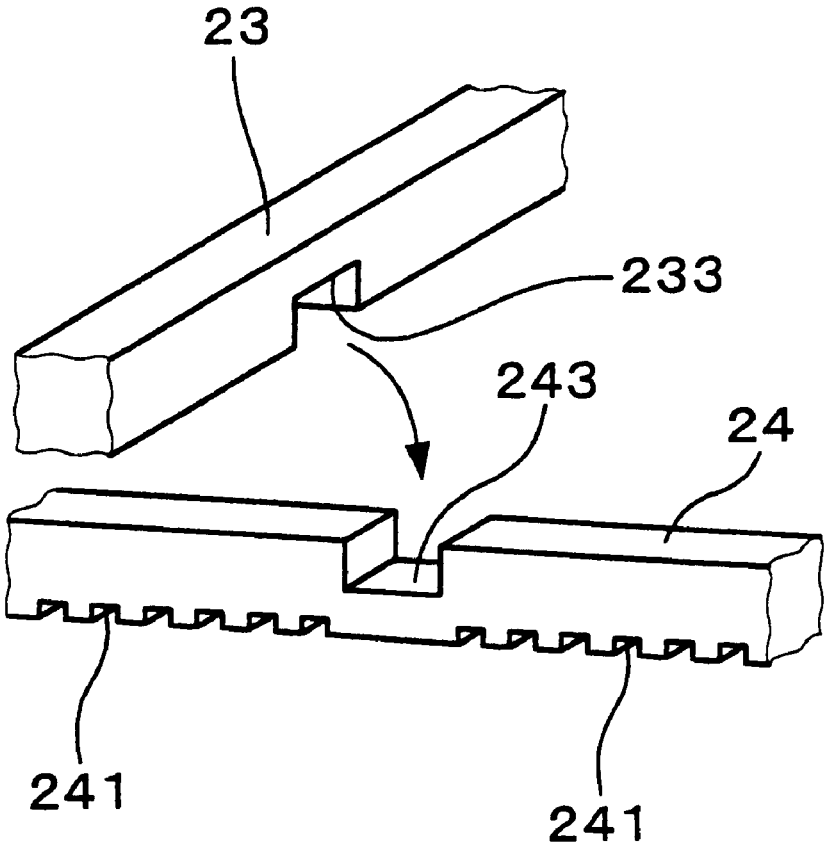
FIG. 13 is an explanatory view of a method for connecting a continuous column and a girth according to Embodiment 4.
Figure 14:
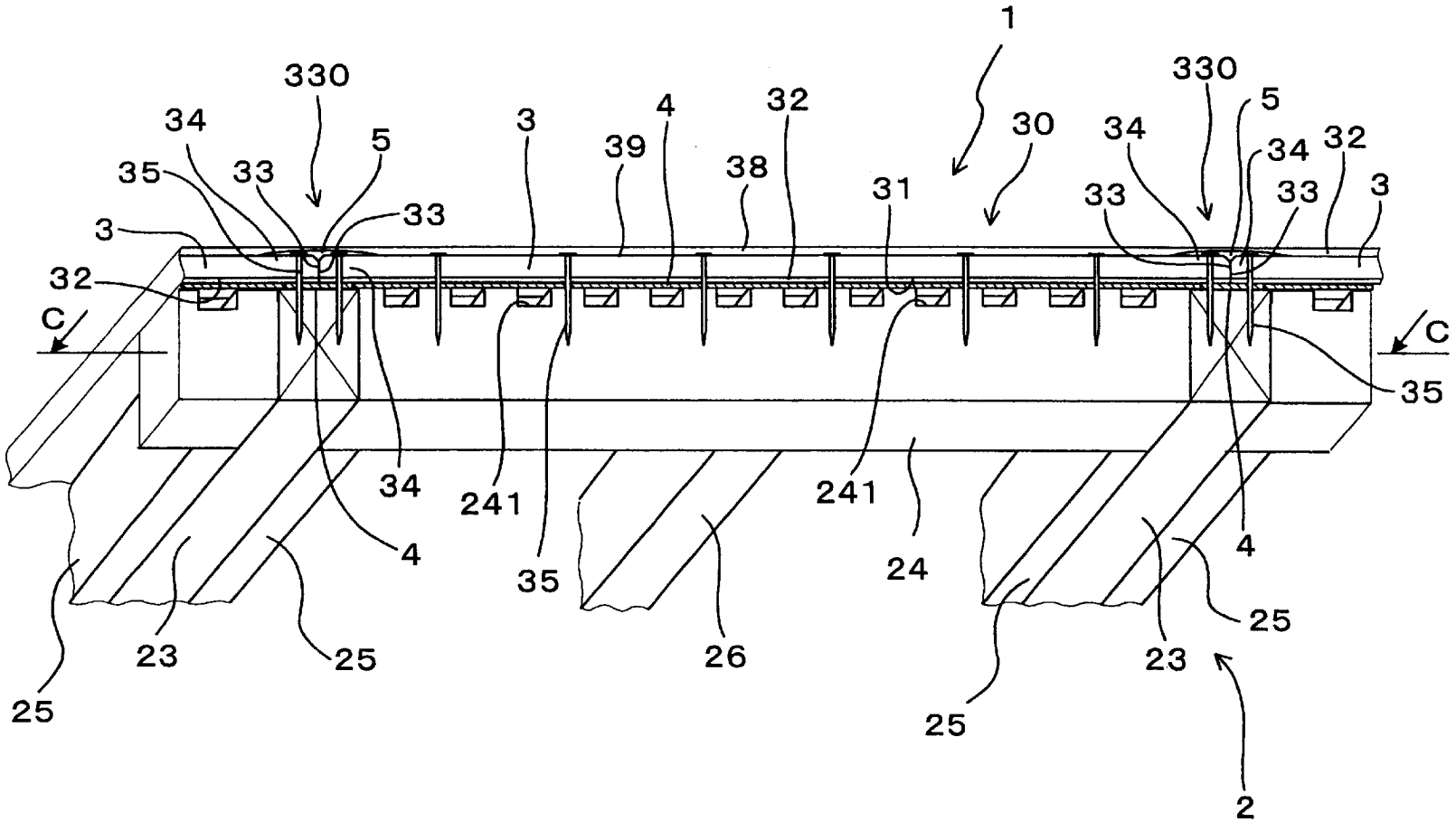
FIG. 14 is a cross-sectional perspective view of the external wall construction according to Embodiment 5.

The continuous columns 23 and the girths 24 are respectively formed with notched portions 233 and 243 as illustrated in FIG. 13, and both members are joined by fitting these notched portions 233 and 243 with each other.

Thereafter, the waterproof tapes 4 are adhered to the base 22, continuous columns 23 and girths 24 of the building framework 2. A plurality of external wall panels 3 preliminarily backed with resin sheets 32 (see FIG. 10) is then adhered from above the waterproof tapes 4 by abutting lateral end portions 33 of the panels to each other. The integrally formed bearing wall 30 is completed by fixing the external wall panels 3 to the building framework 2 by driving nails 35 into the building framework 2 from the surface sides of the external wall panels 3 (see FIG. 8).

The covering materials 5 are further provided on the butt portions 330 and the shiplap joint portions 36 of the external wall panels 3 as illustrated in FIG. 8.

The coating material 38 is thereafter applied onto the entire front surface 39 of the bearing wall 30 as illustrated in FIGS. 8 and 10.

Actions and effects of the present embodiment will now be explained.

As explained above, the external wall construction 1 comprises the building framework 2 and the plurality of external wall panels 3. The external wall construction 1 is thus of simple arrangement and may be easy to be constructed. Decreases in material costs can also be achieved due to the small number of constituents.

Owing to the fact that the external wall construction 1 does not utilize furring strips as conventional structures do, the overall thickness can be reduced to contribute to increase effective indoor spaces of buildings.

Further, since the external wall panels 3 are formed by backing resin sheets 32 on rearward surfaces 31 thereof, cracks or chippings (see FIG. 21) of the rearward surfaces 31 of the external wall panels 3 caused through face-nailing can be prevented. Accordingly, water or carbon dioxide will not be absorbed from the cracks or chippings formed on the rearward surfaces 31 so that no dimensional changes of the external wall panels 3 will be caused, and carbonation or neutralization will not be promoted. It is thereby possible to obtain an external wall construction 1 of superior durability.

Waterproof tapes 4 are interposed between the external wall panels 3 and base 22, continuous columns 23, and girths 24. The resin sheets 32 backed to the rearward surfaces of the ceramic type external wall panels 3 serve as waterproof sheets (see FIGS. 8 and 10).

In this manner, penetration of water from clearances formed in joint portions between the external wall panels 3 at rearward surfaces of the butt portions 330 or shiplap joint portions 36 can be reliably prevented.

Notched grooves 241 for ventilation purposes are formed on the girths 24 of the building framework 2 on surfaces of the girths 24 contact the external wall panels 3. Thus, ventilation of the interior of the external wall panels 3 can be secured. More particularly, as illustrated in FIG. 12(B), air 7 is enabled to pass through the external wall panels 3 and the notched grooves 241.

With this arrangement, air 7 of high temperature and humidity in the interior of the building is passed upward and will not be accumulated at rearward surfaces 31 of the external wall panels 3 or peripheries thereof. Thus, air 7 of high temperature and humidity can be prevented from condensing on rearward surfaces 31 of the external wall panels 3, the building framework 2, or heat insulators (not shown in the drawing) disposed on indoor sides of the external wall panels 3. Accordingly, it is possible to obtain an external wall construction 1 of superior durability free of corrosion of the building framework 2.

The external wall panels 3 have a thickness of approximately 15 mm, whereby a sufficient strength of the external wall construction 1 can be secured while further constructions become easy.

Moreover, since the peripheral end portions 34 of the external wall panels 3 are directly fixed to the building framework 2 through nails 35, it is possible to obtain an external wall construction 1 having even superior strength.

Since the waterproof tapes 4 have elasticity, close contact between the external wall panels 3 and the building framework 2 can be achieved, thereby penetration of water from clearances formed between these members can be prevented reliably.

Laterally neighboring external wall panels 3 constituting the bearing wall 30 form butt portions 330, and vertically neighboring external wall panels 3 form shiplap joint portions 36. Covering materials 5 are further provided on front surfaces of the butt portions 330 and the shiplap joint portions 36 (see FIG. 5).

With this arrangement, penetration of water from the butt portions 330 or shiplap joint portions 36 can be reliably prevented while it is enabled to secure sufficient strength of the shiplap joint portions 36. It is further possible to obtain an external wall construction 1 of superior outward design with no joint portions of external wall panels 3 standing out.

Since the coating material 38 is applied on the front surface 39 of the bearing wall 30, it is enabled to obtain an external wall construction 1 of superior outward design. It is also possible to prevent reliably the external wall panels 3 from absorbing water or carbon dioxide from the rearward surfaces 31 of the panels, and dimensional changes of the external wall panels 3 and promotion of carbonization or neutralization can be reliably prevented. It is thus possible to obtain an external wall construction 1 having even superior durability.

As explained so far, the present embodiment is capable of arranging a bearing wall having superior workability, waterproof properties and durability and providing an external wall construction of superior ventilating properties.

It should be noted that while polyethylene sheets are employed as resin sheets in the present embodiment, it is also possible to employ foam polyethylene sheets 321 (see FIG. 11) as in Embodiment 2 or to employ sheets in which foam polyethylene sheets 321 and polyethylene terephthalate nonwoven cloths 322 are overlaid (FIG. 7). In this Embodiment, similarly to Embodiments 2 and 3, waterproof properties, durability and impact-resistance can thus be further improved.

Embodiment 5

The present embodiment is an example of an external wall construction 10 as illustrated in FIGS. 14 to 16(B) in which supporting columns 25 are fixed to lateral sides of continuous columns 23 comprising framings in vertical directions of the building framework 2.

Figure 16A:
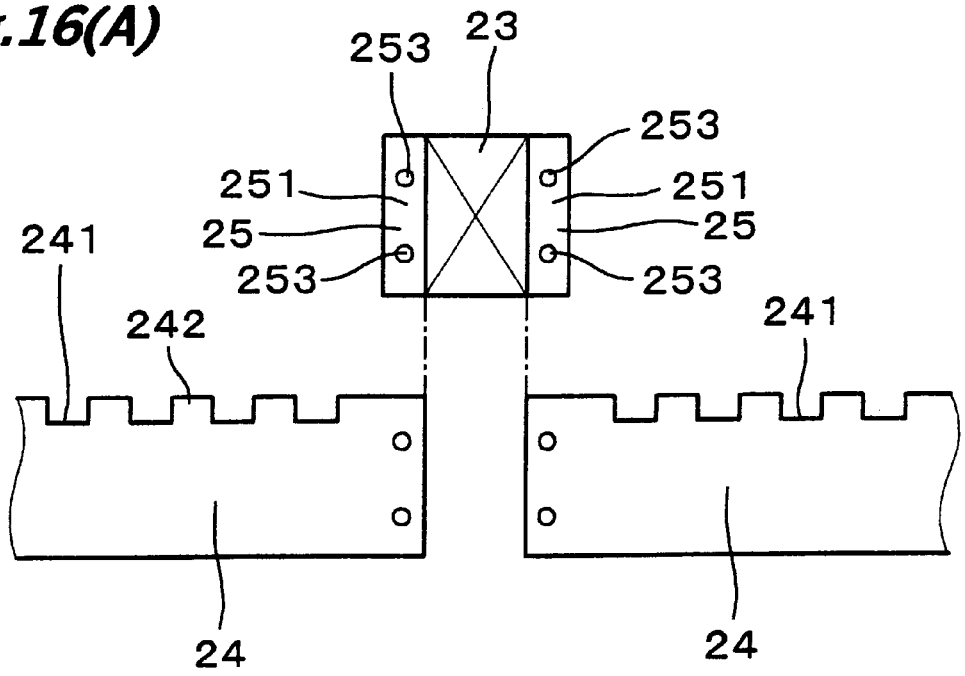
FIG. 16(A) is a top view of a continuous column, supporting columns and girths according to Embodiment 5.
Figure 16B:
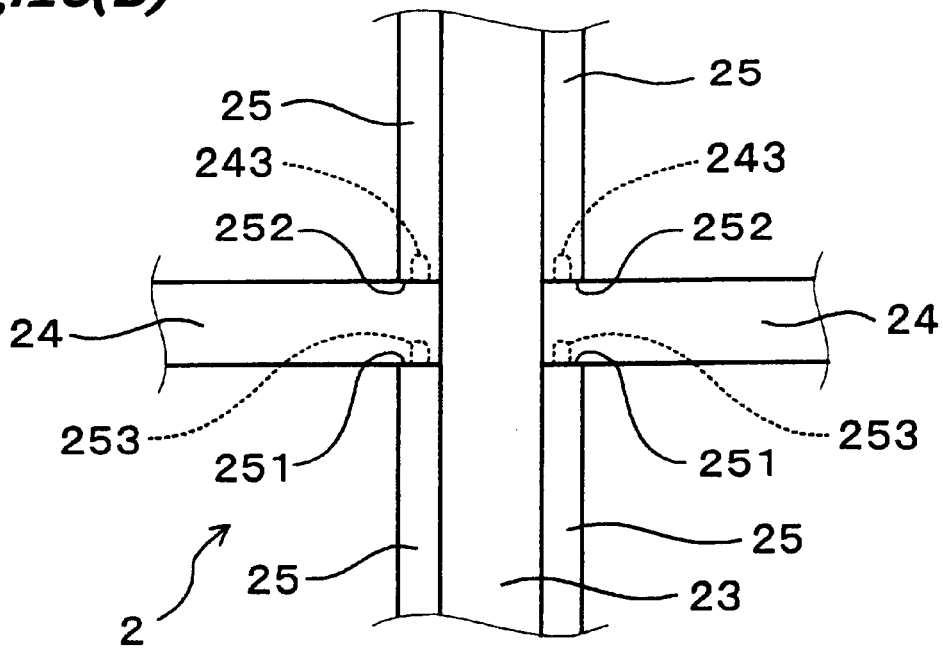
FIG. 16(B) is an explanatory view of a building framework.

More particularly, supporting columns 25 are fixed to both lateral sides of the continuous columns 23 using through bolts, as illustrated in FIG. 16(B). The supporting columns 25 are dimensioned in that they are shorter than the continuous columns 23, smaller in thickness in right and left directions, and identical in width in front and rear directions. Note that the terms "right and left directions" and "front and rear directions" denote right and left directions and front and rear directions when facing the outdoor side of the external wall constructing structure 10.

As illustrated in FIG. 16(B), the girths 24 are fixed to the supporting columns 25 and the continuous columns 23 with end portions of the girths 24 mounted on upper ends 251 of the supporting columns 25.

More particularly, two dowel holes are formed on each upper end 251 of the supporting columns 25 as illustrated in FIG. 16(A), wherein dowels 253 are pounded into the dowel holes while half portions of the dowels are projected upward.

On the other hand, dowel holes are similarly formed on upper and lower lateral surfaces at end portions of the girths 24.

By fitting the dowels 253 of the supporting columns 25 to the dowel holes formed on lateral surfaces at lower sides of the girths 24, the girths 24 are fixed to the upper ends 251 of the supporting columns 25.

Dowels 243 are also pounded into the dowel holes formed on lateral surfaces at upper sides of the girths 24. Additional supporting columns 25 are piled on the girths 24 by fitting the dowel holes formed on lower end butt ends 252 of the columns with the dowels 243 and are fixed to extend along the continuous columns 23.

Figure 15:
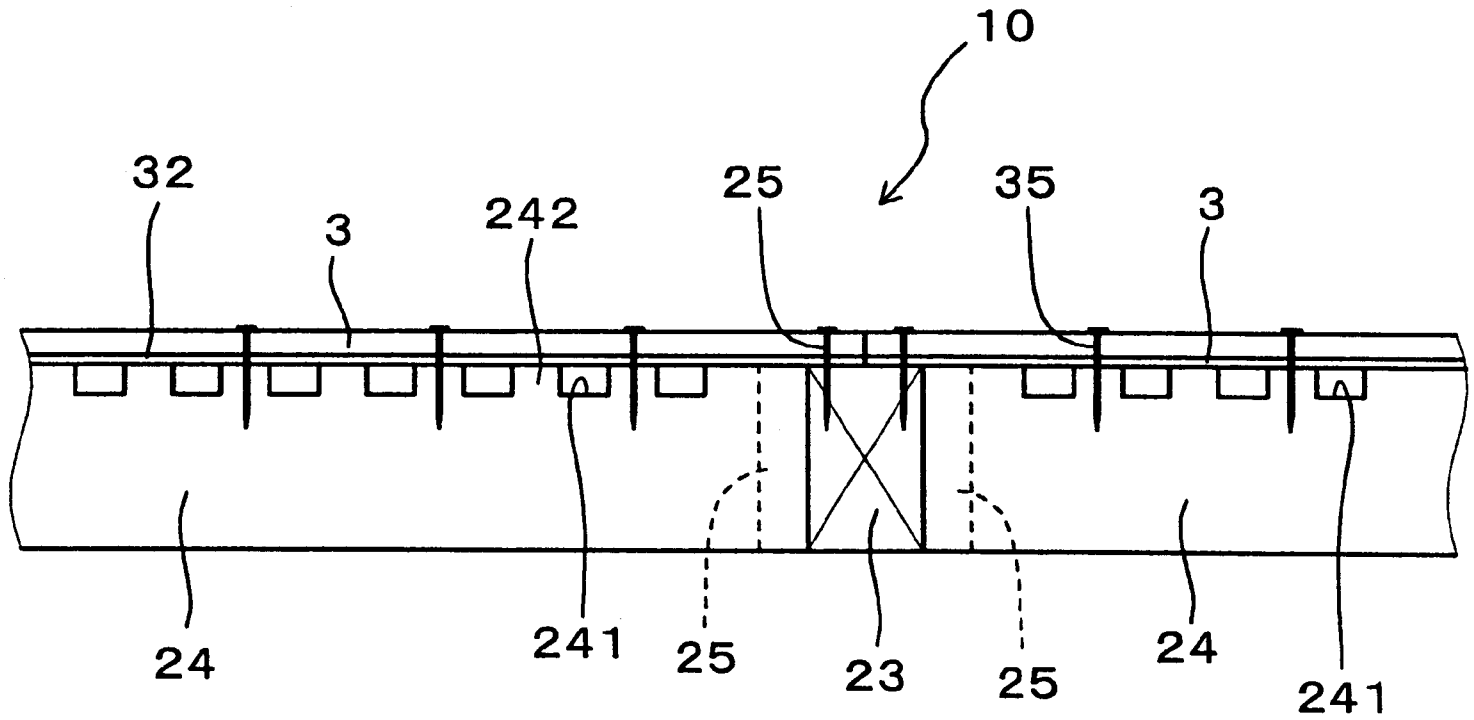
FIG. 15 is a sectional view seen from a direction as indicated by the arrow from line C—C of FIG. 14.

The external wall constructing structure 10 as illustrated in FIG. 15 is then completed by fixing the ceramic type external wall panels 3 onto the building framework 2 arranged in the above manner.

More particularly, in the external wall constructing structure 10, ceramic type external wall panels 3 backed with resin sheets 32 on rearward surfaces 31 thereof are face-nailed to the building framework 2 with the waterproof tapes (not shown in the drawings) being interposed therebetween.

Further, as illustrated in FIG. 15, the lateral end portions of the ceramic type external wall panels 3 are fixed to the continuous columns 23 by driving nails 35 therein. The vertical end portions of the ceramic type external wall panels 3 are fixed to the girths 24 by driving nails 35 therein.

The remaining arrangements are identical to those of Embodiment 4.

According to the present embodiment, it is possible to reinforce the continuous columns 23, and thereby strength of the building framework 2 is secured. The girths 24 can be easily and reliably fixed to the continuous columns 23 through the supporting columns 25.

The present embodiment further exhibits actions and effects identical to those of Embodiment 4.

Embodiment 6

Figure 17:
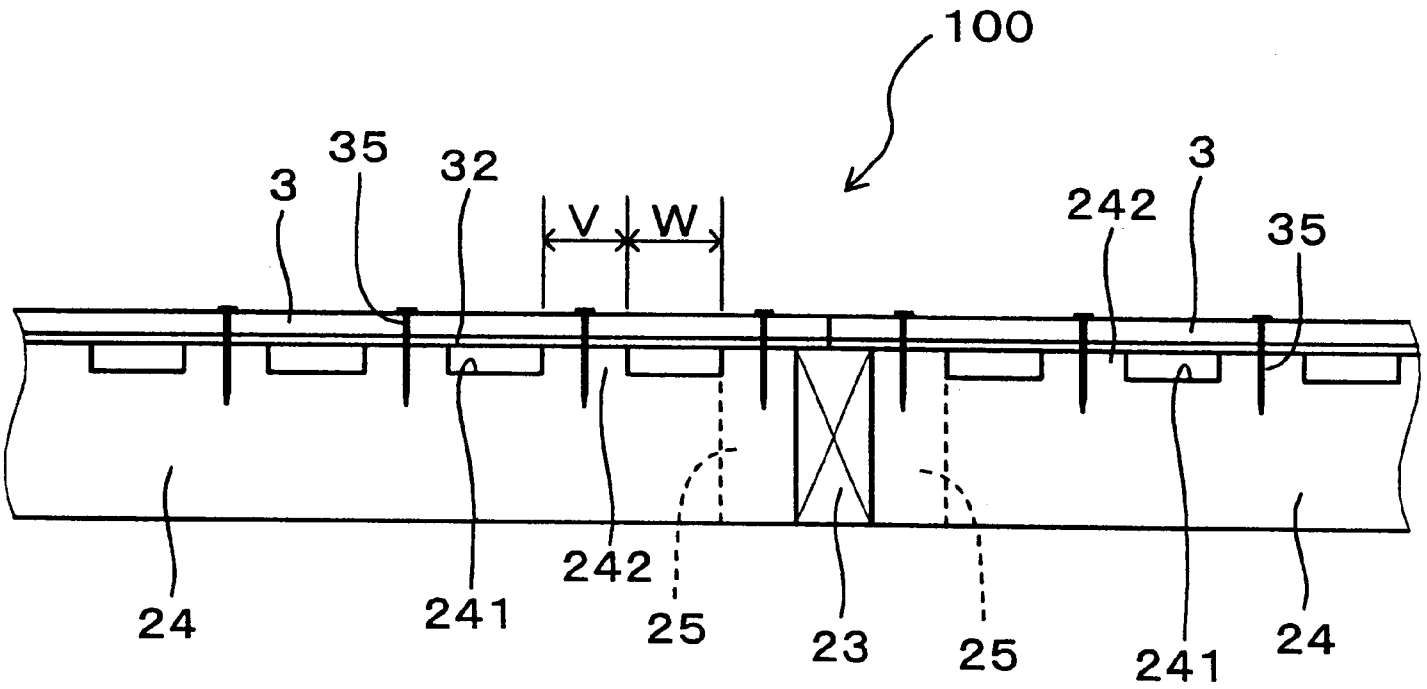
FIG. 17 is a cross-sectional view of the external wall construction according to Embodiment 6.
Figure 18A:
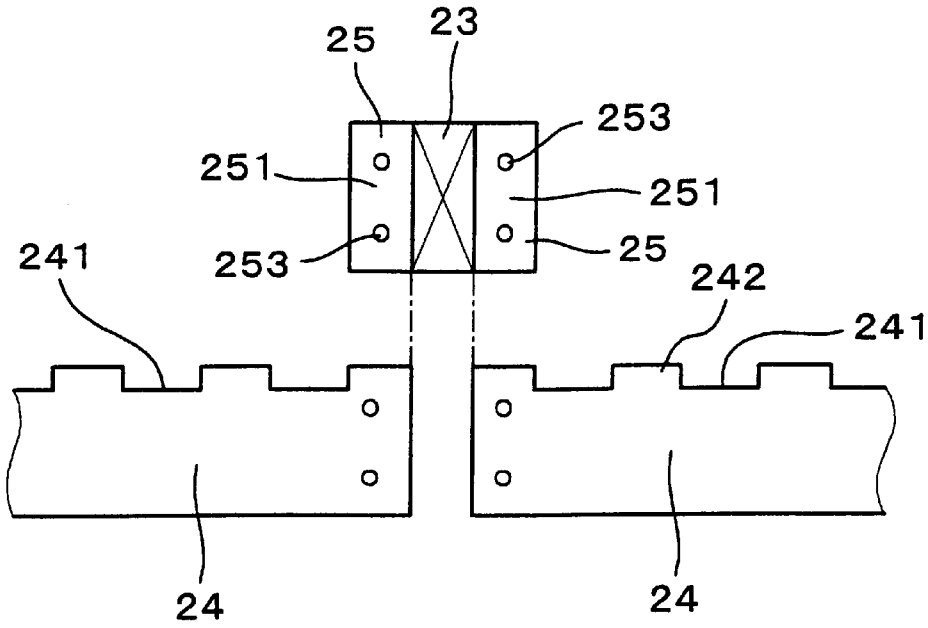
FIG. 18(A) is a top view of a continuous column, supporting columns and girths according to Embodiment 6.
Figure 18B:
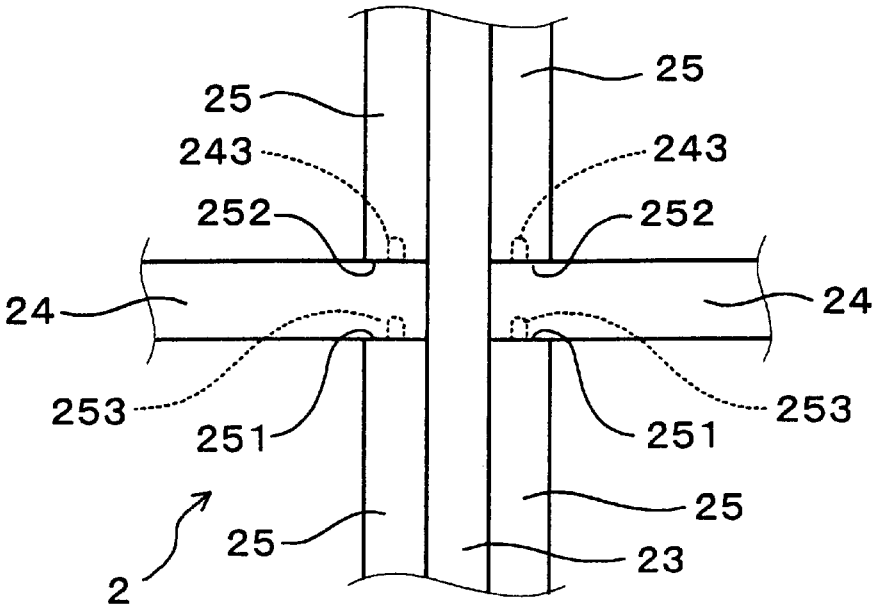
FIG. 18(B) is an explanatory view of a building framework.

The present embodiment is an example of an external wall construction 100 as illustrated in FIGS. 17, FIG. 18(A) and FIG. 18(B) in which the continuous columns 23 and the supporting columns 25 have identical sectional dimensions.

In the present embodiment, a width W of the notched grooves 241 for ventilation and a width V of convex streak portions 242 are set to be larger than those of Embodiment 5. More particularly, both the width W of the notched grooves 241 and the width V of the convex streak portions 242 are 50 mm.

Nails 35 are driven into all of the convex streak portions 242 as illustrated in FIG. 17 for fastening the ceramic type external wall panels 3 to the building framework 2. Lateral end portions of the ceramic type external wall panels 3 are fixed to the supporting columns 25 by driving nails 35.

The remaining arrangements are identical to those of Embodiment 4.

With this arrangement, identical block materials can be used for the continuous columns 23 and the supporting columns 25 by merely adjusting their lengths so that it is possible to further decrease costs for construction. The present embodiment further has actions and effects identical to those of Embodiment 4.

It is obvious that various modification or changes of the present invention may be performed in light of the above techniques. Therefore, it should be understood that the present invention may be embodied in various ways other than those described herein without departing from the scope of the following claims.

What is claimed is:

1. An external wall construction comprising:

a plurality of ceramic external wall panels disposed directly on and fixed to framing materials of a building framework of a building to form a bearing wall, wherein each of the external wall panels have lateral end portions and top and bottom end portions such that the lateral end portions of adjacent ones of the ceramic external wall panels are disposed to abut each other to form a butt portion, wherein the ceramic external wall panels are fixed onto the framing materials of the building framework through face-nailing along the lateral end portions and the top and bottom end portions of the ceramic external wall panels, wherein each of the ceramic external wall panels has a thickness in a range of 12 to 25 mm, wherein resin sheets are fixed on rearward surfaces of each of the external wall panels, wherein waterproof tapes are interposed between the ceramic external wall panels and the framing material of the building framework, wherein the lateral end portions of the ceramic external wall panels are disposed directly on the waterproof tapes, wherein a covering material, constituted of elastic joint finishing materials and mesh-like bodies disposed in the elastic joint finishing materials, is provided on front surfaces of the butt portions where the lateral end portions of the ceramic external wall panels abut each other, and wherein a coating material is applied on a front surface of the bearing wall including over the covering material.

2. The external wall construction according to claim 1, wherein the waterproof tapes have elasticity.

3. The external wall construction according to claim 1, wherein the waterproof tapes closely adhere to both the building framework and the resin sheets attached to the rearward surfaces of the ceramic external wall panels.

4. The external wall construction according to claim 1, wherein vertically neighboring ones of the external wall panels form shiplap joint portions such that an upper tongue portion formed at the bottom end portion of a first panel of the vertically neighboring ones of the external wall panels and a lower tongue portion formed at the top end portion of a second panel of the vertically neighboring ones of the external wall panels are joined together, and the covering material, constituted of the elastic joint finishing materials and the mesh-like bodies disposed in the elastic joint finishing materials, are also provided on a front surface of the shiplap joint portions.

5. The external wall construction according to claim 1, further comprising notched grooves for ventilation purposes which are formed on girths, the girths being one of the framing materials constituting the building framework and the notched grooves being located vertically through top surfaces of the girths which contact the external wall panels.

6. The external wall construction according to claim 5, wherein the rearward surfaces of the external wall panels are disposed on the building framework at peripheral end portions of the external wall portions, and the peripheral end portions of the external wall portions are fixed onto the building framework through face-nailing of nails at specified pitches.

7. The external wall construction according to claim 5, wherein the waterproof tapes have elasticity.

8. The external wall construction according to claim 5, wherein the waterproof tapes closely adhere to both the building framework and the resin sheets fixed to the rearward surfaces of the external wall panels.

9. The external wall construction according to claim 5, wherein vertically neighboring ones of the external wall panels form shiplap joint portions such that an upper tongue portion formed at the bottom end portion of a first panel of the vertically neighboring ones of the external wall panels and a lower tongue portion formed at the top end portion of a second panel of the vertically neighboring ones of the external wall panels are joined together, and the covering material, constituted of the elastic joint finishing materials and the mesh-like bodies disposed in the elastic joint finishing materials, are also provided on a front surface of the shiplap joint portions.

10. The external wall construction according to claim 5, further comprising supporting columns which are fixed to lateral surfaces of continuous columns, the continuous columns being one of the framing materials constituting the building framework.

11. The external wall construction according to claim 10, wherein the continuous columns and the supporting column are of identical sectional dimensions.

12. The external wall construction according to claim 10, wherein end portions of the girths are fixed to upper ends of the supporting columns.

13. The external wall construction according to claim 5, wherein the notched grooves have a depth of 10 to 30 mm and a width of 3 to 150 mm.

14. The external wall construction according to claim 5, further comprising convex streak portions formed between neighboring ones of the notched grooves in the top surface of the girths, wherein the convex streak portions have a width of 60 to 400 mm.

15. The external wall construction according to claim 14, wherein the external wall panels are face-nailed to the convex streak portions of the girths.

* * * * *